US007607904B2

(12) United States Patent
Masuda

(10) Patent No.: US 7,607,904 B2
(45) Date of Patent: Oct. 27, 2009

(54) ROTARY COMPRESSOR WITH LOW PRESSURE SPACE SURROUNDING OUTER PERIPHERAL FACE OF COMPRESSION MECHANISM AND DISCHARGE PASSAGE PASSING THROUGH HOUSING

(75) Inventor: Masanori Masuda, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 11 days.

(21) Appl. No.: 10/574,261

(22) PCT Filed: May 18, 2005

(86) PCT No.: PCT/JP2005/009099

§ 371 (c)(1),
(2), (4) Date: Mar. 31, 2006

(87) PCT Pub. No.: WO2005/113985

PCT Pub. Date: Dec. 1, 2005

(65) Prior Publication Data

US 2007/0065324 A1 Mar. 22, 2007

(30) Foreign Application Priority Data

May 24, 2004 (JP) ..... 2004-152678

(51) Int. Cl.
*F04C 18/00* (2006.01)
*F01C 1/02* (2006.01)

(52) U.S. Cl. ..... 418/62; 418/63

(58) Field of Classification Search ..... 418/62, 418/63, 66, 67, 241
See application file for complete search history.

(56) References Cited

U.S. PATENT DOCUMENTS

| | | | | |
|---|---|---|---|---|
| 1,229,676 | A * | 6/1917 | Tice | 418/59 |
| 3,125,031 | A * | 3/1964 | Rydberg | 418/59 |
| 3,463,091 | A * | 8/1969 | Delsuc | 418/59 |
| 3,563,678 | A * | 2/1971 | Sadler | 418/6 |
| 3,645,653 | A * | 2/1972 | Arnold | 418/56 |
| 3,782,865 | A * | 1/1974 | Braun | 418/56 |
| 3,909,161 | A * | 9/1975 | Stenner | 418/6 |
| 4,235,572 | A * | 11/1980 | Winkler et al. | 418/6 |
| 5,024,114 | A * | 6/1991 | Guttinger | 74/86 |
| 5,383,773 | A * | 1/1995 | Richardson, Jr. | 418/57 |
| 6,746,223 | B2 * | 6/2004 | Manole | 418/55.1 |

(Continued)

FOREIGN PATENT DOCUMENTS

JP 48-107105 U 12/1973

(Continued)

*Primary Examiner*—Thomas Denion
*Assistant Examiner*—Douglas J. Duff
(74) *Attorney, Agent, or Firm*—Global IP Counselors

(57) ABSTRACT

A rotary compressor includes a compression mechanism in which a piston is disposed inside a cylinder chamber of a cylinder. The cylinder and the piston eccentrically rotate relative to each other. The cylinder chamber is sectioned into a high pressure chamber and a low pressure chamber in order to prevent production of vibration and noises due to pressure pulsation caused in a suction process. A low pressure space communicating with a suction side of the compression mechanism and a high pressure space communicating with a discharge side of the compression mechanism are formed in the casing. A suction pipe communicating with the high pressure space and a discharge pipe communicating with the high pressure space are disposed in the casing.

9 Claims, 12 Drawing Sheets

U.S. PATENT DOCUMENTS 6,925,832 B2 * 8/2005 Kitaura et al. ..... 62/324.6

FOREIGN PATENT DOCUMENTS

| | | | |
|---|---|---|---|
| JP | 51-163111 | U | 12/1976 |
| JP | 60-90584 | U | 6/1985 |
| JP | 60-97394 | U | 7/1985 |
| JP | 01-124091 | U | 8/1989 |
| JP | 06-288358 | A | 10/1994 |
| JP | 07-310677 | A | 11/1995 |
| JP | 11-062862 | A | 3/1999 |
| JP | 2000-073974 | A | 3/2000 |
| JP | 2002-543333 | A | 12/2002 |

* cited by examiner

ROTARY COMPRESSOR WITH LOW PRESSURE SPACE SURROUNDING OUTER PERIPHERAL FACE OF COMPRESSION MECHANISM AND DISCHARGE PASSAGE PASSING THROUGH HOUSING

CROSS-REFERENCE TO RELATED APPLICATIONS

This U.S. National stage application claims priority under 35 U.S.C. §119(a) to Japanese Patent Application No. 2004-152678 filed in Japan on May 24, 2004 the entire contents of which are hereby incorporated herein by reference.

TECHNICAL FIELD

The present invention relates to a rotary compressor and more particularly relates to a rotary compressor having a compression mechanism in which a piston is eccentrically accommodated in a cylinder chamber of a cylinder and the cylinder and the piston eccentrically rotate relative to each other.

BACKGROUND ART

Conventional rotary compressors of the above type include one in which refrigerant is compressed by volume change of a cylinder chamber in association with eccentric rotation of an annular piston within an annular cylinder chamber (see for example, Japanese Unexamined Patent Publication No. 6-288358). In the compressor (100), a hermetic casing (110) accommodates a compression mechanism (120) and a motor (not shown) for driving the compression mechanism (120), as shown in FIG. 11 and FIG. 12 (a cross-sectional view taken along the line XII-XII in FIG. 11: not hatched).

The compression mechanism (120) includes a cylinder (121) having an annular cylinder chamber (C1, C2) and an annular piston (122) arranged in the cylinder chamber (C1, C2). The cylinder (121) includes an outer cylinder (124) and an inner cylinder (125) which are arranged coaxially so that the cylinder chamber (C1, C2) is formed between the outer cylinder (124) and the inner cylinder (125).

The cylinder (121) is fixed to the casing (110). Furthermore, the annular piston (122) is coupled through a circular piston base (160) to an eccentric portion (133*a*) of a drive shaft (133) connected to the motor to eccentrically rotate around the center of the drive shaft (133).

The annular piston (122) eccentrically rotates while keeping substantially in contact at one point of its outer peripheral face with the inner peripheral face of the outer cylinder (124) (wherein "substantially in contact" means a state in which though a minute gap is present to an extent that an oil film is formed, leakage of refrigerant in the gap is ignorable) and substantially in contact, at one point of the inner peripheral face 180° different in phase from the above contact point, with the outer peripheral face of the inner cylinder (125). Thus, an outer cylinder chamber (C1) and an inner cylinder chamber (C2) are formed on the outside and the inside of the annular piston (122), respectively.

An outer blade (123A) is arranged outside the annular piston (122), and an inner blade (123B) is arranged inside the annular piston (123) on an extension line of the outer blade (123A). The outer blade (123A) is forced inward in the radial direction of the annular piston (122) so that the inner peripheral end thereof is pressed against the outer peripheral face of the annular piston (122). The inner blade (123B) is forced outward in the radial direction of the annular piston (122) so that the outer peripheral end thereof is pressed against the inner peripheral face of the annular piston (122).

The outer blade (123A) divides the outer cylinder chamber (C1) into two chambers, and the inner blade (123B) divides the inner cylinder chamber (C2) into two chambers. To be specific, the outer blade (123A) divides the outer cylinder chamber (C1) into a low pressure chamber (C1-Lp) and a high pressure chamber (C1-Hp), and the inner blade (123B) divides the inner cylinder chamber (C2) into a low pressure chamber (C2-Lp) and a high pressure chamber (C2-Hp). Further, in the outer cylinder (124), a suction port (141) for allowing the outer cylinder chamber (C1) to communicate with an suction pipe (114) provided at a casing (110) is formed in the vicinity of the outer blade (123A). Also, in the annular piston (122), a through hole (143) is formed in the vicinity of the suction port (141) so that the low pressure chamber (C1-Lp) of the outer cylinder chamber (C1) and the low pressure chamber (C2-Lp) of the inner cylinder chamber (C2) communicate with each other through the through hole (143). Further, a discharge port (not shown) for allowing the high pressure chambers (C1-Hp, C2-Hp) of the cylinder chambers (C1, C2) to communicate with a high pressure space (S) in the casing (110) is formed in the compression mechanism (120).

In this example, in order to allow only eccentric rotation (orbital motion) while preventing rotation of the annular piston (122) on the axis thereof, an Oldham mechanism (161) is provided as a mechanism for preventing the rotation of the annular piston (122) on the axis thereof.

In the above compression mechanism (120), when the drive shaft (133) rotates to eccentrically rotate the annular piston (122), volume expansion and contraction are repeated alternately in both the outer cylinder chamber (C1) and the inner cylinder chamber (C2). In the volume expansion of each cylinder chamber (C1, C2), a suction process is performed in which refrigerant is sucked into the cylinder chamber (C1, C2) from the suction port (141). Performed in the volume contraction are a compression process in which refrigerant is compressed in the cylinder chamber (C1, C2) and a discharge process in which refrigerant is discharged from the cylinder chamber (C1, C2) to the high pressure space (S) in the casing (110) through the discharge port. Thus, the high-pressure refrigerant discharged into the high pressure space (S) of the casing (110) flows into a condenser of a refrigerant circuit through a discharge pipe (115) provided in the casing (110).

As illustrated in FIG. 13, an example obtained by partly modifying the structure of the rotary compressor illustrated in FIG. 12 is also disclosed in Japanese Unexamined Patent Publication No. 6-288358. In this compression mechanism (120), an annular piston (122) is cut to form a shape of C, and a single blade (123) passes through the cut part of the piston (122) and is thus in contact with the inner peripheral face of the outer cylinder (124) and the outer peripheral face of the inner cylinder (125). A part of the inner peripheral face of the outer cylinder (124) being in contact with the blade (123) is formed to have the same radius of curvature as the outer peripheral face of the inner cylinder (125). Furthermore, an unshown Oldham mechanism is provided to allow eccentric rotation (orbital motion) of the annular piston (122) around the inner cylinder (125) and prevent rotation of the annular piston (122) on the axis thereof. This example is similar to examples illustrated in FIGS. 11 and 12 in that the suction process, compression process and discharge process for refrigerant are performed according to the eccentric rotation of the annular piston (122).

SUMMARY OF THE INVENTION

Problems that the Invention is to Solve

In the conventional structures of the compressor illustrated in FIGS. 11 through 13, a suction pipe is direct-coupled to a low pressure chamber (C1-Lp, C2-Lp) of a cylinder chamber (C1, C2). Therefore, the pressure pulsation caused in the suction process in each cylinder chamber (C1, C2) propagates through the suction pipe into the system of a refrigerant circuit. This causes vibration of apparatuses or pipes for the refrigerant circuit and noises.

The present invention has been made in view of the above problems, and an object of the present invention is to prevent vibration and noises due to the pressure pulsation caused in a suction process in a rotary compressor having a compression mechanism which is configured such that an annular piston is placed inside an annular cylinder chamber of a cylinder and the cylinder eccentrically rotates relative to the annular piston and in which the cylinder chamber is divided into a high pressure chamber and a low pressure chamber by a blade.

Means of Solving the Problems

According to the present invention, a low pressure space (S1) serving as a buffer space in the suction of a suction gas into a compression mechanism (20) is disposed in a casing (10). This prevents pressure pulsation caused in a suction process from propagating through a suction pipe (14) into the system of a refrigerant circuit.

To be specific, a first aspect of the invention is based on a rotary compressor comprising: a compression mechanism (20) including a cylinder (21) having a cylinder chamber (C) (C1, C2), a piston (22) accommodated in the cylinder chamber (C) (C1, C2) eccentrically with respect to the cylinder (21), and a blade (23) arranged in the cylinder chamber (C) (C1, C2) and sectioning the cylinder chamber (C) (C1, C2) into a high pressure chamber (C-Hp) (C1-Hp, C2-Hp) and a low pressure chamber (C-Lp) (C1-Lp, C2-Lp), the cylinder (21) and the piston (22) eccentrically rotating relative to each other; a motor (30) for driving the compression mechanism (20); and a casing (10) for accommodating the compression mechanism (20) and the motor (30).

In this rotary compressor, a low pressure space (S1) communicating with a suction side of the compression mechanism (20) and a high pressure space (S2) communicating with a discharge side of the compression mechanism (20) are formed in the casing (10), and the casing (10) is provided with a suction pipe (14) connected to the low pressure space (S1) side of the casing (10) and a discharge pipe (15) connected to the high pressure space (S2) side thereof.

According to the first aspect of the invention, a suction gas flows through the suction pipe (14) into the low pressure space (S1) in the casing (10) and then is sucked into the compression mechanism (20). The gas sucked into the compression mechanism (20) is compressed to a high pressure by the compression mechanism (20), and the compressed gas flows into the high pressure space (S2) in the casing (10) and then discharged from the discharge pipe (15).

According to a second aspect of the invention, in the rotary compressor of the first aspect of the invention, two spaces may be formed in the casing (10) with the compression mechanism (20) interposed therebetween, one of the two spaces may be the high pressure space (S1), and the other thereof may be the low pressure space (S2).

According to the second aspect of the invention, the suction gas passing through the suction pipe (14) flows into the low pressure space (S1) defined in the casing (10) by the compression mechanism (20) and then sucked into the compression mechanism (20) to have a high pressure. Furthermore, the high pressure gas flows into the high pressure space (S2) formed so as to be opposed to the low pressure space (S1) with the compression mechanism (20) interposed therebetween and then is discharged from the discharge pipe (15).

According to a third aspect of the invention, in the rotary compressor of the first aspect of the invention, the motor (30) may be disposed in the high pressure space (S2).

According to the third aspect of the invention, a gas discharged from the compression mechanism (20) passes through the high pressure space (S2) while flowing around the motor (30), and is discharged from the discharge pipe (15).

According to a fourth aspect of the invention, in the rotary compressor of the first aspect of the invention, the high pressure space (S2) may be formed below the compression mechanism (20), and an oil sump (19) for accumulating lubrication oil may be formed in the high pressure space (S2).

According to the fourth aspect of the invention, lubrication oil is accumulated in the high pressure space (S2) filled with the discharged gas from the compression mechanism (20). This allows a high pressure of the discharged gas to work on the lubrication oil.

According to a fifth aspect of the invention, in the rotary compressor of the first aspect of the invention, the outer peripheral face of the compression mechanism (20) may be surrounded by the low pressure space (S1).

According to the fifth aspect of the invention, the outer peripheral face of the compression mechanism (20) is surrounded by the low pressure space (S1). Therefore, the surrounding temperature of the compression mechanism (20) is low. This can prevent a suction gas from being affected by a high-temperature discharge gas contained in the high pressure space (S2).

According to a sixth aspect of the invention, in the rotary compressor of the first aspect of the invention, the cylinder chamber (C1, C2) may be formed in an annular shape in section at a right angle in an axial direction, and the piston (22) may be formed of an annular piston (22) arranged in the cylinder chamber (C1, C2) and sectioning the cylinder chamber (C1, C2) into an outer cylinder chamber (C1) and an inner cylinder chamber (C2). "The section at a right angle in the axial direction" herein means a section at a right angle with respect to the drive shaft (the rotation center).

According to the sixth aspect of the invention, in a rotary compressor including a compression mechanism (20) in which an annular piston (22) is eccentrically accommodated in an annular cylinder chamber (C1, C2) and the annular cylinder chamber (C1, C2) is sectioned into an outer cylinder chamber (C1) and an inner cylinder chamber (C2), a suction gas flows through the suction pipe (14) into the low pressure space (S1) in the casing (10) and then is sucked into the compression mechanism (20). The gas sucked into the compression mechanism (20) is compressed to a high pressure by the compression mechanism (20), and the compressed gas flows into the high pressure space (S2) in the casing (10) and then discharged from the discharge pipe (15).

According to a seventh aspect of the invention, in the rotary compressor of the sixth aspect of the invention, the blade (23) may be formed continuously with the cylinder (21), the rotary compressor may further include a coupling member (27) through which the annular piston (22) and the blade (23) are movably coupled to each other, and the coupling member (27) may include a first sliding face (P1) corresponding to the annular piston (22) and a second sliding face (P2) corresponding to the blade (23).

According to the seventh aspect of the invention, the drive of the compression mechanism (20) allows the cylinder (21) and the annular piston (22) to eccentrically rotate relative to each other. In this eccentric rotation, the annular piston (22) and the blade (23) swing relative to each other with a predetermined point as the swing center and move back and forth relative to each other in the direction along the face of the blade (23). When the volume of the cylinder chamber (C1, C2) is increased, a gas is sucked into the cylinder chamber (C1, C2). When the volume of the cylinder chamber (C1, C2) is decreased, the gas is compressed.

In the structure of a known rotary compressor illustrated in FIGS. 11 and 12, blades (123A, 123B) are in line contact with an annular piston (122). In the structure of a known rotary compressor illustrated in FIG. 13, a blade (123) is in line contact with cylinders (124, 125). Therefore, a large load is applied to the contact portions of the annular piston (122) when the annular piston (122) eccentrically rotates during operation. This may cause the wearing-away and burning of the contact portions.

Furthermore, in the structure of the known rotary compressors illustrated in FIGS. 11 through 13, the above members are in line contact with each other in the previously-described manner. Therefore, the contact portions have an inferior sealing function, and a leak of a gas from high pressure chambers (C1-Hp, C2-Hp) of both an outer cylinder chamber (C1) and an inner cylinder chamber (C2) to low pressure chambers (C1-Hp, C2-Hp) thereof may reduce the compression efficiency.

According to the present invention, when the blade (23) and the annular piston (22) are in motion (relative swinging and reciprocating motions) with the coupling member (27) interposed therebetween, the coupling member (27) is substantially in surface contact at its sliding faces (P1, P2) with the annular piston (22) and the blade (23), respectively. This reduces the load working on the contact portions and makes it less likely to cause the wearing-out and burning of the contact portions. Furthermore, since the above members are in surface contact with each other in the previously-described manner, this can prevent a leak of a gas from the contact portions as compared with the structure of a rotary compressor in which the above members are in line contact with each other as in Patent Document 1.

According to an eighth aspect of the invention, in the rotary compressor of the seventh aspect of the invention, the annular piston (22) may have a shape of C obtained by cutting an annular ring, the blade (23) may be formed to extend from an inner peripheral wall surface of the annular cylinder chamber (C1, C2) to an outer peripheral wall surface thereof while being inserted through the cut part of the annular piston (22), and the coupling member (27) may be a swing bush (27) having an arc-shaped outer peripheral face slidably supported in the cut part of the annular piston (22), a blade groove (28) being formed therein for supporting the blade (23) to allow the blade (23) to move back and forth.

According to the eighth aspect of the invention, the drive of the compression mechanism (20) allows the blade (23) to move back and forth while being in surface contact with the blade groove (28) in the swing bush (27) and allows the swing bush (27) to swing while being in surface contact with the cut part of the annular piston (22). In this manner, the faces of the coupling member (27) are in contact with respective associated faces of the annular piston (22) and the blade (23) with reliability, and a leak of a gas from the contact portions can be prevented with reliability.

According to a ninth aspect of the invention, the rotary compressor of the sixth aspect of the invention may further comprise a drive shaft (33) for driving the compression mechanism (20), wherein the drive shaft (33) may comprise an eccentric portion (33*a*) that is eccentric from the rotation center, the eccentric portion (33*a*) being coupled to the cylinder (21) or the annular piston (22), and parts of the drive shaft (33) located to both longitudinal sides of the eccentric portion (33*a*) may be supported through the bearing portions (16*a*, 17*a*) in the casing (10).

According to the ninth aspect of the invention, the drive shaft (33) for driving the compression mechanism (20) rotates while its parts located to both longitudinal sides of the eccentric portion (33*a*) are supported through the bearing portions (16*a*, 17*a*) in the casing (10). Therefore, an action of the compression mechanism (20) is stabilized.

According to a tenth aspect of the invention, in the rotary compressor of the first aspect of the invention, the cylinder chamber (C) may have a circular shape in section at a right angle in an axial direction, and the piston (22) may be formed of a circular piston (22) arranged in the cylinder chamber (C).

According to the tenth aspect of the invention, in a rotary compressor including a compression mechanism (20) in which a circular piston (22) is eccentrically accommodated in a circular cylinder chamber (C), a suction gas flows through the suction pipe (14) into the low pressure space (S1) in the casing (10) and then is sucked into the compression mechanism (20). The gas sucked into the compression mechanism (20) is compressed to a high pressure by the compression mechanism (20), and the compressed gas flows into the high pressure space (S2) in the casing (10) and then discharged from the discharge pipe (15).

EFFECTS OF THE INVENTION

According to the first aspect of the invention, a low pressure space (S1) communicating with a suction side of a compression mechanism (20) and a high pressure space (S2) communicating with a discharge side of the compression mechanism (20) are formed in the casing (10), and the casing (10) is provided with a suction pipe (14) connected to the low pressure space (S1) side thereof and a discharge pipe (15) connected to the high pressure space (S2) side thereof. Therefore, a suction pipe (14) is exposed inside the low pressure space (S1) without direct-coupling the suction pipe (14) to the suction side of the compression mechanism (20). This allows the low pressure space (S1) to form a buffer space in the suction of a suction gas into the compression mechanism (20). Therefore, pressure pulsation caused in the suction process in a cylinder chamber (C) (C1, C2) of the compression mechanism (20) does not propagate through the suction pipe (14) into the system of a refrigerant circuit. This can prevent vibration of apparatuses or pipes for the refrigerant circuit and production of noises.

Furthermore, a discharge gas passes through the high pressure space (S2) and is ejected from the discharge pipe (15). Since the heat of the discharge gas therefore does not travel to the suction side, this prevents deterioration in the performance of a compressor due to loss caused by superheat of suction gas. Furthermore, after the high pressure space (S2) has been filled with the discharge gas, the discharge gas is ejected from the discharge pipe (15). This can avoid influence of pulsation resulting from the pressure at which the discharge gas is discharged on the discharge pipe.

Moreover, even when liquid is mixed into a low pressure gas sucked into the compressor, the liquid and the gas are separated from each other in the low pressure space, thereby sucking only the gas into the compression mechanism (20). Thus, some suction structures of the compressor can prevent liquid compression, resulting in the avoided damage to the compression mechanism (20).

According to the second aspect of the invention, two spaces are formed inside the casing (10) with the compression mechanism (20) interposed between the two spaces. One of the two spaces is a low pressure space (S1), and the other thereof is a high pressure space (S2). The low pressure space (S1) and the high pressure space (S2) can be formed with a simple structure. This can prevent the size of the compressor (1) from increasing without complicating the structure thereof.

According to the third aspect of the invention, a motor (30) is disposed in the high pressure space (S2). Therefore, a gas discharged from the compression mechanism (20) flows around the motor (30), and a gas sucked into the compression mechanism (20) does not flow around the motor (30). Since the suction gas is therefore not heated by the motor (30), this certainly prevents deterioration in the performance of a compressor due to loss caused by superheat of the suction gas.

According to the fourth aspect of the invention, since the high pressure space (S2) is formed below the compression mechanism (20) and an oil sump (19) is formed in the high pressure space (S2), lubrication oil can be supplied to, for example, a sliding portion of the compression mechanism (20) by utilizing a high pressure of the discharge gas. This can simplify the structure of the lubrication mechanism.

According to the fifth aspect of the invention, the outer peripheral face of the compression mechanism (20) is surrounded by the low pressure space (S1). Therefore, the surrounding temperature of the compression mechanism (20) is low. This can prevent a suction gas from being affected by a high-temperature discharge gas contained in the high pressure space (S2) and thus being superheated.

According to the sixth aspect of the invention, in a rotary compressor including a compression mechanism (20) in which an annular piston (22) is eccentrically accommodated in an annular cylinder chamber (C1, C2) and the annular cylinder chamber (C1, C2) is sectioned into an outer cylinder chamber (C1) and an inner cylinder chamber (C2), pressure pulsations at both the suction and discharge sides can be prevented, and deterioration in the performance of the compressor due to loss caused by superheat of suction gas can also be prevented.

According to the seventh aspect of the invention, since during the operation of the compression mechanism (20) the coupling member (27) is substantially in surface contact at its sliding faces (P1, P2) with the annular piston (22) and the blade (23), respectively, this can reduce the load working on the contact portions of the annular piston (22) per unit area as compared with the structure of a rotary compressor in which the above members are in line contact with each other as in Patent Document 1. This makes it less likely to cause the wearing-out and burning of the contact portions when the blade (23) and the annular piston (22) slide with the coupling member (27) interposed therebetween during operation. Furthermore, since the coupling member (27) is in surface contact at its sliding faces (P1, P2) with the annular piston (22) and the blade (23), respectively, this can prevent a gas from leaking from between a first chamber (C1-Hp, C2-Hp) and a second chamber (C1-Lp, C2-Lp).

According to the eighth aspect of the invention, a swing bush (27) in which a blade groove (28) is formed for supporting the blade (23) to allow the blade (23) to move back and forth and which has an arc-shaped outer peripheral face slidably supported in the cut part of the annular piston (22) is used as the coupling member (27), this can certainly avoid a gas leakage during operation and the wearing-out and burning of members and also prevent the structure of a coupling member of the rotary compressor from becoming complicated. This can prevent increases in the size of a mechanism and cost.

According to the ninth aspect of the invention, since a drive shaft (33) for driving the compression mechanism (20) rotates while being supported at its parts located to both longitudinal sides of its eccentric portion (33*a*) through the bearing portions (16*a*, 17*a*) in the casing (10), the operation of the compression mechanism (20) is stabilized. This improves the reliability of the mechanism (20).

According to the tenth aspect of the invention, in a rotary compressor including a compression mechanism (20) in which a circular piston (22) is eccentrically accommodated in a circular cylinder chamber (C), pressure pulsations at both the suction and discharge sides can be prevented, and deterioration in the performance of the compressor due to loss caused by superheat of suction gas can also be prevented.

DETAILED DESCRIPTION OF THE INVENTION

Embodiments of the present invention will be described hereinafter with reference to the drawings.

Embodiment 1 of Invention

Figure 1:
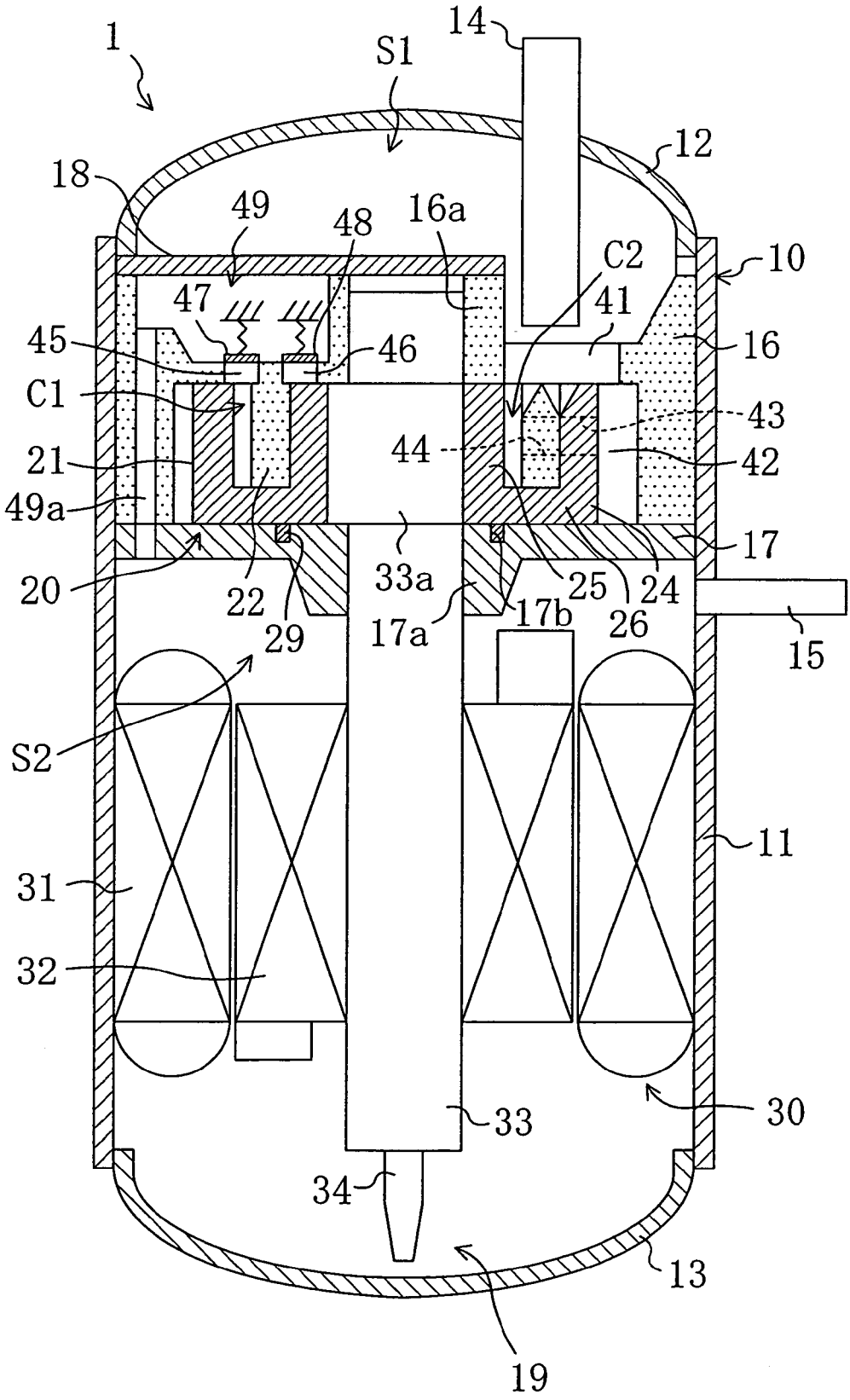
FIG. 1 is a longitudinal cross-sectional view illustrating a rotary compressor according to a first embodiment of the present invention.

As illustrated in FIG. 1, a rotary compressor (1) of this embodiment is configured hermetically as a whole such that a compression mechanism (20) and a motor (a drive mechanism) (30) are accommodated in a casing (10). The compressor (1) is used to compress refrigerant sucked from an evaporator and discharge the refrigerant to a condenser, e.g., in a refrigerant circuit of an air conditioner.

The casing (10) is composed of a cylindrical body portion (11), an upper end plate (12) fixed to the upper end of the body portion (11), and a lower end plate (13) fixed to the lower end of the body portion (11). A suction pipe (14) is provided in the upper end plate (12) to pass through the upper end plate (12). A discharge pipe (15) is provided in the body portion (11) to pass through the body portion (11).

Figure 2:
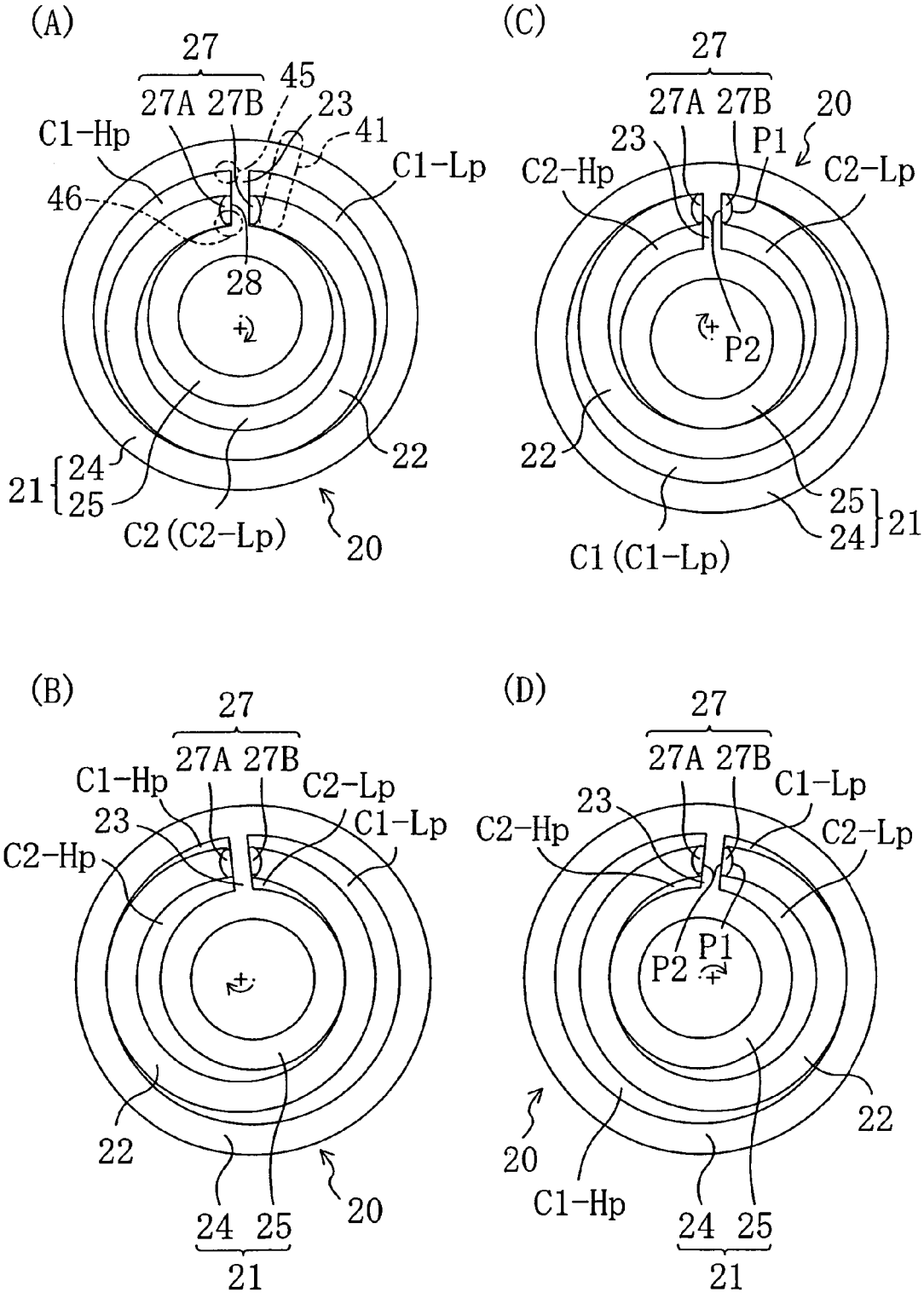
FIG. 2 are transverse cross-sectional views illustrating an operation of a compression mechanism of the first embodiment.

The compression mechanism (20) is arranged between an upper housing (16) and a lower housing (17) which are fixed to the casing (10). The compression mechanism (20) includes a cylinder (21) that comprises a cylinder chamber (C1, C2) having an annular shape in section at a right angle in the axial direction, an annular piston (22) arranged in the cylinder chamber (C1, C2), and a blade (23) which sections the cylinder chamber (C1, C2) into a high pressure chamber (compression chamber) (C1-Hp, C2-Hp) and a low pressure chamber (suction chamber) (C1-Lp, C2-Lp) as illustrated in FIG. 2. The cylinder (21) and the annular piston (22) rotate eccentrically relative to each other. In the first embodiment, the cylinder (21) having the cylinder chamber (C1, C2) is movable, and the annular piston (22) disposed in the cylinder chamber (C1, C2) is fixed.

The motor (30) includes a stator (31) and a rotor (32). The stator (31) is placed below the compression mechanism (20) and fixed to the body portion (11) of the casing (10). The rotor (32) is coupled to a drive shaft (33) to rotate the drive shaft (33) with the rotation of the rotor (32). The drive shaft (33) vertically passes through the cylinder chamber (C1, C2).

The drive shaft (33) is provided with an oil-supply passage (not shown) extending axially within the drive shaft (33). An oil-supply pump (34) is disposed at the lower end of the drive shaft (33). The oil-supply passage extends upwardly, i.e., from the oil-supply pump (34) toward the compression mechanism (20). With this structure, lubrication oil accumulated in an oil sump (19) of the later-described high-pressure space (S2) in the casing (10) is supplied through the oil-supply passage to a sliding portion of the compression mechanism (20) by the oil-supply pump (34).

A portion of the drive shaft (33) located inside the cylinder chamber (C1, C2) is formed with an eccentric portion (33*a*). The eccentric portion (33*a*) has a diameter larger than parts of the drive shaft (33) above and below the eccentric portion (33*a*) and is eccentric from the axial center of the drive shaft (33) by a predetermined distance.

The cylinder (21) includes an outer cylinder (24) and an inner cylinder (25). The outer cylinder (24) and the inner cylinder (25) are connected at their lower ends with each other through an end plate (26) so as to be integrated. The inner cylinder (25) is slidably fitted onto the eccentric portion (33*a*) of the drive shaft (33).

The annular piston (22) is formed continuously with the upper housing (16). The upper housing (16) and the lower housing (17) are formed with bearing portions (16*a*, 17*a*) for supporting the drive shaft (33), respectively. In view of the above, the compressor (1) of this embodiment takes on a through-axis structure in which the drive shaft (33) vertically passes through the cylinder chamber (C1, C2) and parts of the drive shaft (33) located to both longitudinal sides of the eccentric portion (33*a*) are supported through the bearing portions (16*a*, 17*a*) in the casing (10).

The compression mechanism (20) includes a swing bush (27) as a coupling member through which the annular piston (22) and the blade (23) are movably coupled to each other. The annular piston (22) has a shape of C obtained by cutting an annular ring. The blade (23) is configured to extend from an inner peripheral wall surface of the cylinder chamber (C1, C2) (the outer peripheral face of the inner cylinder (25)) to an outer peripheral wall surface thereof (the inner peripheral face of the outer cylinder (24)) while being inserted through the cut part of the annular piston (22) in a radial direction of the cylinder chamber (50) and fixed to the outer cylinder (24) and the inner cylinder (25). The annular piston (22) and the blade (23) are coupled through the swing bush (27) to each other in the cut part of the annular piston (22). The blade (23) may be formed continuously with the outer cylinder (24) and the inner cylinder (25) as illustrated in FIG. 2, and another member may be integrated with both the cylinders (24, 25).

The inner peripheral face of the outer cylinder (24) and the outer peripheral face of the inner cylinder (25) form concentrically disposed cylindrical faces, and the cylinder chamber (C1, C2) is formed therebetween. The annular piston (22) is formed such that its outer peripheral face has a smaller diameter than the inner peripheral face of the outer cylinder (24) and its inner peripheral face has a larger diameter than the outer peripheral face of the inner cylinder (25). Thus, an outer cylinder chamber (C1) is formed between the outer peripheral face of the annular piston (22) and the inner peripheral face of the outer cylinder (24), and an inner cylinder chamber (C2) is formed between the inner peripheral face of the annular piston (22) and the outer peripheral face of the inner cylinder (25).

When the outer peripheral face of the annular piston (22) makes substantially contact with the inner peripheral face of the outer cylinder (24) at one point (strictly speaking, there is a gap on the order of microns but no significant leak of refrigerant from the gap), the inner peripheral face of the annular piston (22) substantially makes contact with the outer peripheral face of the inner cylinder (25) at one point having a phase difference of 180 degrees from the point at which the outer peripheral face of the annular piston (22) makes contact with the inner peripheral surface of the outer cylinder (24).

The swing bush (27) include a discharge-side bush (27A) located at the side of the blade (23) closer to a high pressure chamber (C1-Hp, C2-Hp) and a suction-side bush (27B) located at the side thereof closer to a low pressure chamber (C1-Lp, C2-Lp). The discharge-side bush (27A) and the suction-side bush (27B) are formed in the same shape to both have generally semicircular cross sections and disposed to oppose their flat faces to each other. A space between the opposed faces of the discharge-side bush (27A) and suction-side bush (27B) forms a blade groove (28).

The blade (23) is inserted into the blade groove (28). The flat faces (second sliding faces (P2): see FIG. 2(C)) of the swing bush (27A, 27B) are substantially in surface contact with the blade (23), and arc-shaped outer peripheral faces (first sliding faces (P1)) of the swing bush (27) are substantially in surface contact with the annular piston (22). The swing bush (27A, 27B) is configured such that the blade (23) moves back and forth within the blade groove (28) in the direction along the face of the blade (23) with the blade (23) caught in the blade groove (28). At the same time, the swing bush (27A, 27B) is configured to swing relative to the annular piston (22) together with the blade (23). In other words, the swing bush (27) is configured such that the blade (23) and the annular piston (22) can swing relative to each other with the central point between the swing bush (27) as the swing center and the blade (23) can move back and fourth relative to the annular piston (22) in the direction along the face of the blade (23).

Although in this embodiment both the bushes (27A, 27B) are independent of each other, both the bushes (27A, 27B) may be partly coupled to each other so as to be integrated.

With the above structure, the rotation of the drive shaft (33) allows the outer cylinder (24) and the inner cylinder (25) to swing with the central point between the swing bush (27) as the swing center while the blade (23) moves back and forth within the blade groove (28). This swing action allows the contact points between the piston (22) and the cylinder (21) to move in the following order: FIG. 2(A), FIG. 2(B), FIG. 2(C), and FIG. 2(D). In this case, the outer cylinder (24) and the inner cylinder (25) move around the drive shaft (33) but do not rotate on their axes.

A suction port (41) is formed in a part of the upper housing (16) located immediately below the suction pipe (14). The suction port (41) ranges wide from the inner cylinder chamber (C2) to a suction space (42) formed around the outer cylinder (24). The suction port (41) passes axially through the upper housing (16) to allow the low pressure chambers (C1-Lp, C2-Lp) of the cylinder chamber (C1, C2) and the suction space (42) to communicate with an upper space (a low pressure space (S1)) above the upper housing (16). In the outer cylinder (24), a through hole (43) is formed for allowing the suction space (42) to communicate with the low pressure chamber (C1-Lp) of the outer cylinder chamber (C1). In the annular piston (22), a through hole (44) is formed for allowing the low pressure chamber (C1-Lp) of the outer cylinder (C1) to communicate with the low pressure chamber (C2-Lp) of the inner cylinder chamber (C2).

The outer cylinder (24) and the annular piston (22) are wedge-shaped by chamfering the upper ends of their parts corresponding to the suction port (41). This permits efficient suction of refrigerant into the low pressure chamber (C1-Lp, C2-Lp).

Discharge ports (45, 46) are formed in the upper housing (16). The discharge ports (45, 46) pass axially through the upper housing (16). The lower end of the discharge port (45) opens to the high pressure chamber (C1-Hp) of the outer cylinder chamber (C1) while the lower end of the discharge port (46) opens to the high pressure chamber (C2-Hp) of the inner cylinder chamber (C2). On the other hand, the upper ends of the discharge ports (45, 46) communicate with a discharge space (49) through discharge valves (reed valves) (47, 48) for opening/closing the discharge ports (45, 46), respectively.

The discharge space (49) is formed between the upper housing (16) and a cover plate (18). A discharge passage (49*a*) for allowing the discharge space (49) and the space (a high pressure space (S2)) below the lower housing (17) to communicate with each other is formed in the upper housing (16) and the lower hosing (17).

A sealing ring (29) is disposed in the lower housing (17). The sealing ring (29) is inserted into an annular groove (17*b*) of the lower housing (17) and pressed against the lower face of the end plate (26) of the cylinder (21). Furthermore, high-pressure lubrication oil is introduced onto a part of the face of the lower housing (17) being in contact with the cylinder (21) and located radially inside the sealing ring (29). With the above structure, the sealing ring (29) forms a compliance mechanism for reducing the size of an axial gap between the lower end face of the annular piston (22) and the end plate (26) of the cylinder (21) by utilizing the pressure of the lubrication oil.

—Running Operation—

Next, an operation of the compressor (1) will be described.

With the startup of the motor (30), rotation of the rotor (32) is transmitted through the drive shaft (33) to the outer cylinder (24) and the inner cylinder (25) of the compression mechanism (20). Then, the blade (23) produces a reciprocating motion (back- and forth-motion) in between the swing bushes (27A, 27B) and swings relative to the annular piston (22) together with the swing bushes (27A, 27B). In this case, the swing bushes (27A, 27B) are substantially in surface contact at their sliding faces (P1, P2) with the annular piston (22) and the blade (23). In view of the above, the outer cylinder (24) and the inner cylinder (25) revolve around the annular piston (22) while swinging relative to the piston (22). In this way, the compression mechanism (20) performs a predetermined compression operation.

To be specific, the drive shaft (33) rotates clockwise in FIG. 2 from the state illustrated in FIG. 2(D) in which the low pressure chamber (C1-Lp) of the outer cylinder chamber (C1) has substantially a minimum volume. When the volume of the low pressure chamber (C1-Lp) increases with its state changing in the order of FIGS. 2(D), 2(A), 2(B) and 2(C), refrigerant passes through the suction pipe (14), the low pressure space (S1) and the suction port (41) and is sucked into the low pressure chamber (C1-Lp). In this case, the refrigerant is not only directly sucked from the suction port (41) into the low pressure chamber (C1-Lp) but also partly enters from the suction port (41) into the suction space (42) and is sucked through the suction space (42) and the through hole (43) into the low pressure chamber (C1-Lp).

When the drive shaft (33) makes a single revolution and thus the state of the outer cylinder (C1) is again returned to the state illustrated in FIG. 2(D), the suction of refrigerant into the low pressure chamber (C1-Lp) terminates. At this point, the low pressure chamber (C1-Lp) becomes a high pressure chamber (C1-Hp) where the refrigerant is compressed while another low pressure chamber (C1-Lp) is formed with the blade (23) between the high pressure chamber (C1-Hp) and the low pressure chamber (C1-Lp). When the drive shaft (33) further rotates from this state, the refrigerant sucking is repeated in the low pressure chamber (C1-Lp) while the volume of the high pressure chamber (C1-Hp) decreases to compress the refrigerant in the high pressure chamber (C1-Hp). Then, when the pressure of the high pressure chamber (C1-Hp) becomes a predetermined value and the pressure difference from the discharge space (49) reaches a set value, the discharge valve (47) is opened by the high-pressure refrigerant in the high pressure chamber (C1-Hp) to allow the high-pressure refrigerant to flow through the discharge space (49) and the discharge passage (49*a*) into the high pressure space (S2).

The drive shaft (33) rotates clockwise in FIG. 2 from the state illustrated in FIG. 2(B) in which the low pressure chamber (C2-Lp) of the inner cylinder chamber (C2) has substantially a minimum volume. When the volume of the low pressure chamber (C2-Lp) increases with its state changing in the order of FIGS. 2(B), 2(C), 2(D), and 2(A), refrigerant passes through the suction pipe (14), the low pressure space (S1) and the suction port (41) and is sucked into the low pressure chamber (C2-Lp). In this case, the refrigerant is not only directly sucked from the suction port (41) into the low pressure chamber (C2-Lp) but also partly enters from the suction port (41) into the suction space (42) and is sucked through the suction space (42), the through hole (43), the low pressure chamber (C1-Lp) of the outer cylinder chamber, and the through hole (44) into the low pressure chamber (C2-Lp) of the inner cylinder chamber (C2).

When the drive shaft (33) makes a single revolution and thus the state of the outer cylinder (C1) is again returned to the state illustrated in FIG. 2(B), the suction of the refrigerant into the low pressure chamber (C2-Lp) terminates. At this point, the low pressure chamber (C2-Lp) becomes the high pressure chamber (C2-Hp) where the refrigerant is compressed while another low pressure chamber (C2-Lp) is formed with the blade (23) between the high pressure chamber (C2-Hp) and the low pressure chamber (C2-Lp). When the drive shaft (33) further rotates from this state, the refrigerant sucking is repeated in the low pressure chamber (C2-Lp) while the volume of the high pressure chamber (C2-Hp) decreases to compress the refrigerant in the high pressure chamber (C2-Hp). Then, when the pressure of the high pressure chamber (C2-Hp) becomes a predetermined value and the pressure difference from the discharge space (49) reaches a set value, the discharge valve (48) is opened by the high-pressure refrigerant in the high pressure chamber (C2-Hp) to allow the high-pressure refrigerant to flow through the discharge space (49) and the discharge passage (49*a*) into the high pressure space (S2).

In this way, the high-pressure refrigerant compressed by the outer cylinder chamber (C1) and the inner cylinder chamber (C2) and flowing into the high pressure space (S2) is discharged from the discharge pipe (15), undergoes the condensation process, the expansion process, and the evaporation process in the refrigerant circuit, and then, is sucked again into the rotary compressor (1).

Effects of Embodiment 1

In the first embodiment, the inner end of a suction pipe (14) is exposed inside a low pressure space (S1) without direct-coupling the suction pipe (14) to low pressure chambers (suction chambers) (C1-Lp, C2-Lp) of the compression mechanism (20). This allows the low pressure space (S1) to form a buffer space in the suction of a suction gas into a compression mechanism (20). Therefore, pressure pulsation caused in the suction process in each cylinder chamber (C1, C2) does not propagate through the suction pipe (14) into the system of a refrigerant circuit. This can prevent vibration of apparatuses or pipes for the refrigerant circuit and production of noises. For a discharge side, a discharge space (S2) is filled with a discharge gas and then the discharge gas is ejected through a discharge pipe (15). This can avoid influence of pressure pulsation at the discharge side on a discharge pipe.

Two spaces are formed inside a casing (10) with the compression mechanism (20) interposed between the two spaces. The two spaces include a low pressure space (S1) and a high pressure space (S2). The low pressure space (S1) and the high pressure space (S2) can be formed with a simple structure. This can prevent the size of the compressor (1) from increasing without complicating the structure thereof.

Furthermore, since a motor (30) is disposed in the high pressure space (S2), a discharge gas discharged from the compression mechanism (20) flows around the motor (30), and a suction gas sucked into the compression mechanism (20) does not flow around the motor (30). Since the suction gas is therefore not heated by the motor (30), this prevents deterioration in the performance of the compressor due to loss caused by superheat of suction gas. Furthermore, since the low pressure space (S1) and the high pressure space (S2) are separated from each other with the compression mechanism (20) interposed therebetween, a passage for a low pressure gas and a passage for a high pressure gas, which are located in the casing (10), are completely separated from each other. This can also prevent deterioration in the performance of the compressor due to loss caused by superheat of suction gas.

Since the high pressure space (S2) is formed below the compression mechanism (30) and an oil sump (19) is formed in the high pressure space (S2), lubrication oil can be supplied to, for example, a sliding portion of the compression mechanism (20) by utilizing a high pressure of the discharge gas. This can simplify the structure of the lubrication mechanism.

Furthermore, since a drive shaft (33) for driving the compression chamber (20) rotates while being supported at its parts located at both longitudinal sides of its eccentric portion (33*a*) through the bearing portions (16*a*, 17*a*) in the casing (10), the operation of the compression mechanism (20) is stabilized. This improves the reliability of the mechanism (20).

The line contact between the swing bush (27) and the annular piston (22) or the blade (23) may be considered to cause the wearing-away of the annular piston (22) and the blade (23) and the burning of the contact portions thereof during operation. However, in the first embodiment, the swing bush (27) are provided as coupling members through which the annular piston (22) and the blade (23) are coupled to each other and are configured to be substantially in surface contact at their sliding faces (P1, P2) with the annular piston (22) and the blade (23). In view of the above, the above problem can be solved.

Furthermore, the use of the swing bush (27) as coupling members can prevent the structure of a coupling portion of the compressor from being complicated. This can prevent increase in the size and cost of the mechanism.

Since the swing bush (27) is provided in surface contact with the annular piston (22) and the blade (23), this allows portions of the swing bush (27) being in contact with the annular piston (22) and the blade (23) to have an excellent sealing function. This can certainly prevent a leak of refrigerant from the high pressure chamber (C1-Hp, C2-Hp) to the low pressure chamber (C1-Lp, C2-Lp) of each of the outer cylinder chamber (C1) and the inner cylinder chamber (C2), leading to the prevented reduction in compression efficiency.

Furthermore, according to the compressor (1) of this embodiment, there is a phase difference of 180 degrees between the torque fluctuations associated with a compression operation in the outer cylinder chamber (C1) and the torque fluctuations associated with a compression operation in the inner cylinder chamber (C2). Therefore, the amplitude of the entire torque curve is made smaller than that of a compressor of a one-cylinder type. When this amplitude is large, this causes problems, such as vibration and noises of the compressor (1). In this embodiment, such problems can be avoided. The structure of the compressor (1) producing only a low noise level eliminates the need for a soundproofing material, resulting in the reduced cost.

Furthermore, the structure of, for example, a conventional two-cylinder type compressor in which one compression mechanism is placed on another (see Japanese Unexamined Patent Publication No. 2000-161276) becomes complicated, resulting in the increased cost. However, in the compressor (1) of this embodiment, two cylinder chambers (C1, C2) formed in a single compression mechanism (20) can offer an equivalent capability to the two-cylinder type compressor, simplify the structure of the compressor (1) and reduce the cost thereof.

Furthermore, according to the structure of the compressor of this embodiment, on condition that the high pressure in the high pressure chamber (C1-Hp, C2-Hp) of each cylinder chamber (C1, C2) abnormally increases when liquid is returned from an evaporator of a refrigerant circuit to a compressor (1) due to a change in operating conditions, the sealing ring (29) becomes deformed, leading to a cylinder (21) displaced downward. In this way, liquid refrigerant can be leaked from the high pressure chamber (C1-Hp, C2-Hp) to the low pressure chamber (C1-Lp, C2-Lp). This can prevent liquid compression. As a result, it is less likely to cause a failure of the compression mechanism (20), resulting in the improved reliability.

Since in the first embodiment the blade (23) is formed continuously with the cylinder (21) and supported at both its ends by the cylinder (21), it is less likely to apply an abnormal concentrated load to the blade (23) and cause stress concentration during operation. In view of the above, the sliding portion is less likely to be damaged. This enhances the reliability of the mechanism.

Figure 6:
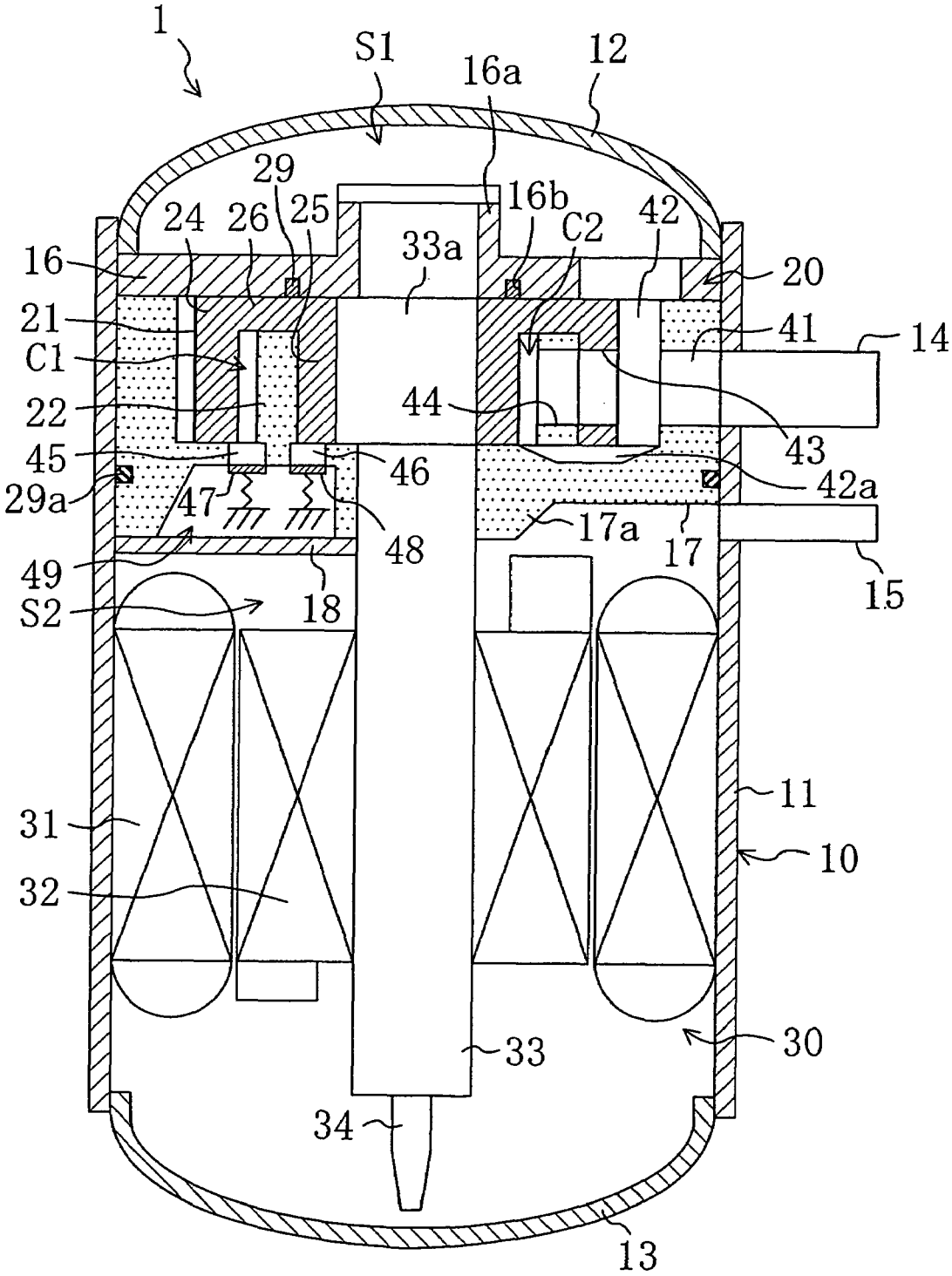
FIG. 6 is a longitudinal cross-sectional view illustrating a rotary compressor according to a second embodiment.
Figure 7:
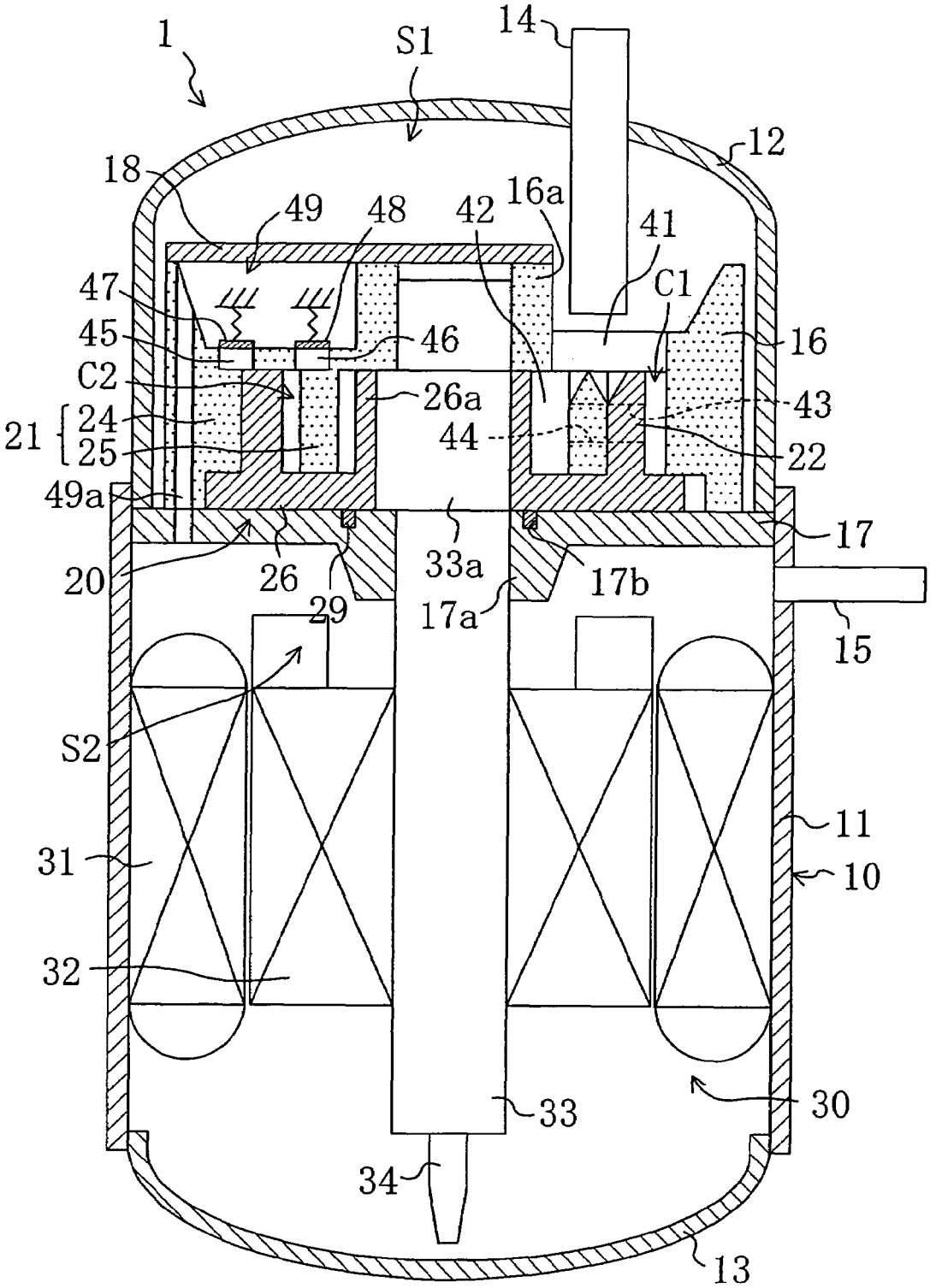
FIG. 7 is a longitudinal cross-sectional view illustrating a rotary compressor according to a third embodiment.
Figure 8:
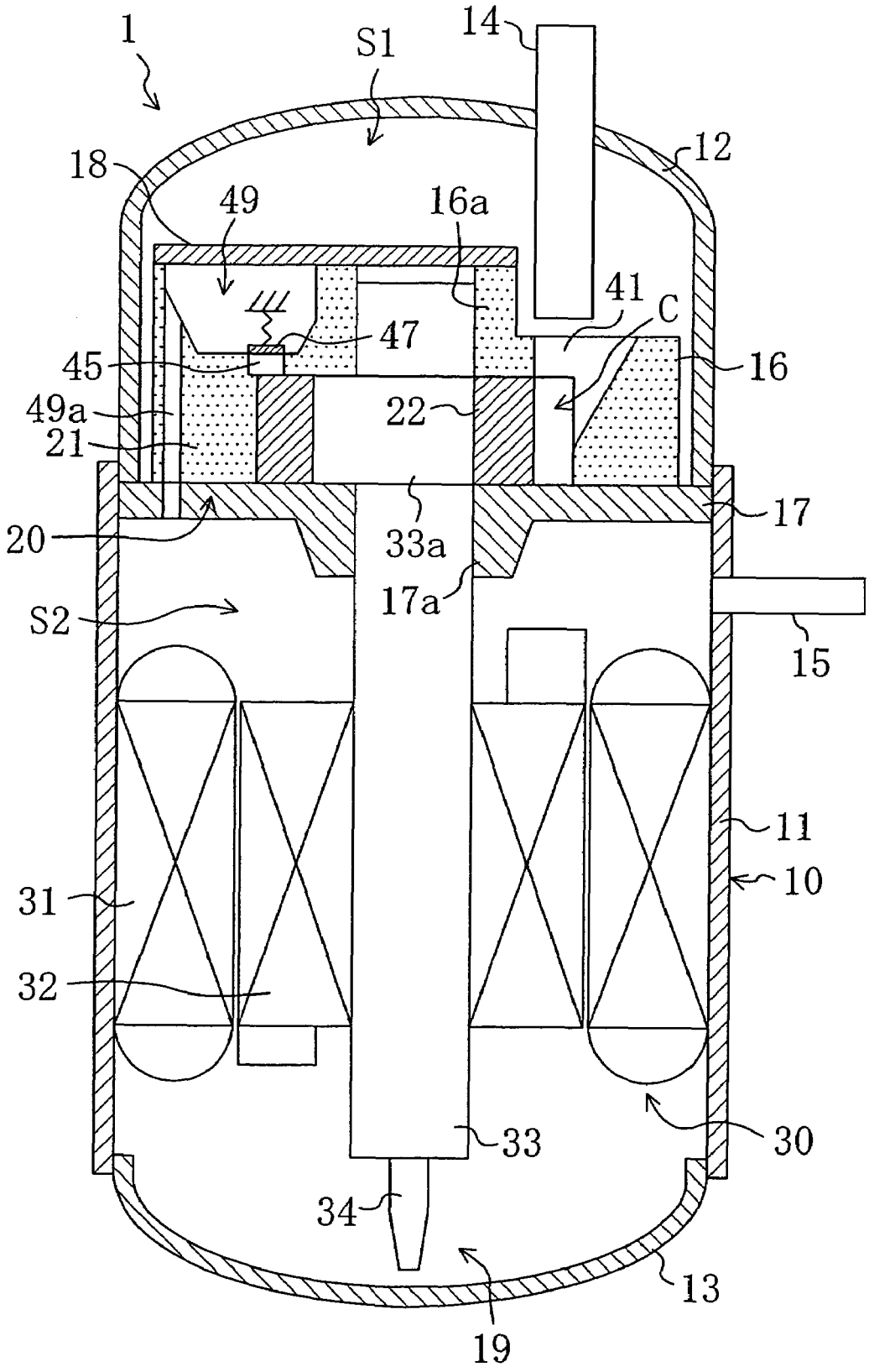
FIG. 8 is a longitudinal cross-sectional view illustrating a rotary compressor according to a fourth embodiment.

In the known compressor illustrated in FIGS. 6 through 8, an Oldham mechanism is used as a anti-rotation mechanism for preventing rotation of the annular piston (22) on the axis thereof and allowing only eccentric rotation of the annular piston (22). However, in the first embodiment, the coupling between the annular piston (22) and the blade (23) through the swing bush (27) serves as an anti-rotation mechanism for the annular piston. This eliminates the need for a dedicated anti-rotation mechanism. As a result, the compressor can be designed to become compact.

Modified Example of Embodiment 1

Modified Example 1

Figure 3:
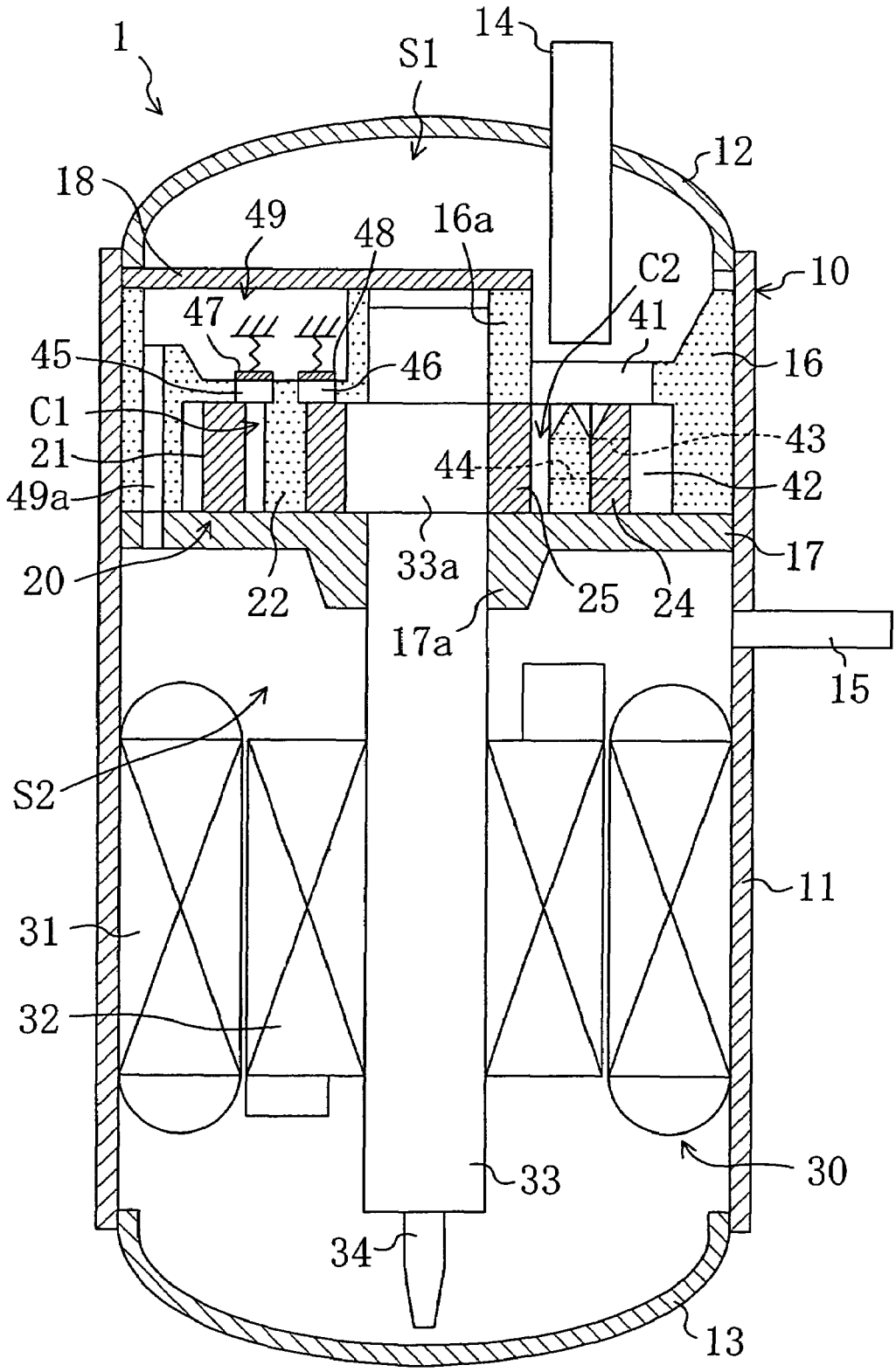
FIG. 3 is a longitudinal cross-sectional view illustrating a rotary compressor according to a first modified example of the first embodiment.

A first modified example of the first embodiment is illustrated in FIG. 3.

In the first modified example, a cylinder (21) is formed without using any end plate (26). To be specific, the cylinder (21) is obtained by continuously forming an outer cylinder (24), an inner cylinder (25) and a blade (23). In this modified example, the sealing ring (29) illustrated in FIG. 1 is not provided.

With this structure, the structure of the cylinder (21) can be simplified, leading to the reduced size of a compression mechanism (20).

The structures of the other components and the other benefits and effects are similar to those of the first embodiment. Therefore, a specific description is not given.

Modified Example 2

Figure 4:
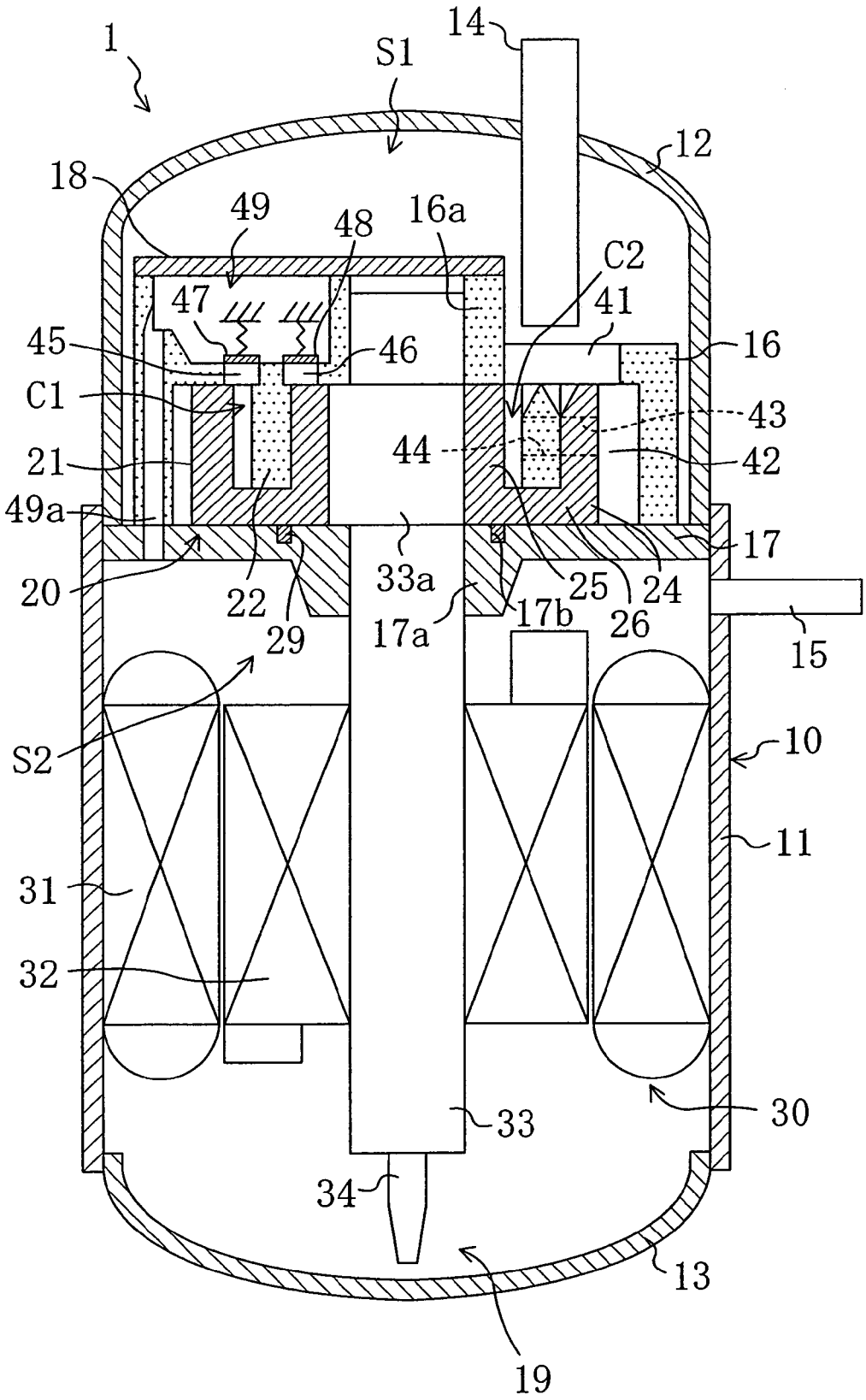
FIG. 4 is a longitudinal cross-sectional view illustrating a rotary compressor according to a second modified example of the first embodiment.

A second modified example of the first embodiment is illustrated in FIG. 4.

In the second modified example, the structure of the inside of a casing (10) in which a body portion (11) and an upper end plate (12) are joined together in the example illustrated in FIG. 1 is changed. In this modified example, the body portion (11) has a length that allows its upper end to project slightly above a lower housing (17), and the lower housing (17) is welded to the body portion (11). Furthermore, an upper housing (16) is formed to have a smaller diameter than the internal diameter of the upper end plate (12) and fixed on the lower housing (17). The upper end plate (12) is welded to an upper end part of the body portion (11).

In this modified example, a high pressure space (S2) is sealed at the locations at which the body portion (11) and the lower housing (17) are joined together. Therefore, a low pressure space (S1) above the lower housing (17) is completely isolated from the high pressure space (S2). Unlike this modified example, in the structure illustrated in FIG. 1, the lower housing (17) and the upper housing (16) are fitted into the body portion (11). This may cause that a high-pressure gas may leak through a minute gap between the body portion (11) and the lower housing (17) around the upper housing (16).

On the other hand, in this modified example, the high pressure space (S2) is sealed at the locations at which the body portion (11) and the lower housing (17) are joined together, and a space is produced between the upper end plate (12) and the upper housing (16) so that the outer peripheral face of the compression mechanism (20) is surrounded by the low pressure space (S1). In view of the above, a high-temperature discharge gas inside the high pressure space (S2) does not leak around the upper housing (16). This can certainly prevent a suction gas from being superheated by the discharge gas.

Modified Example 3

Figure 5:
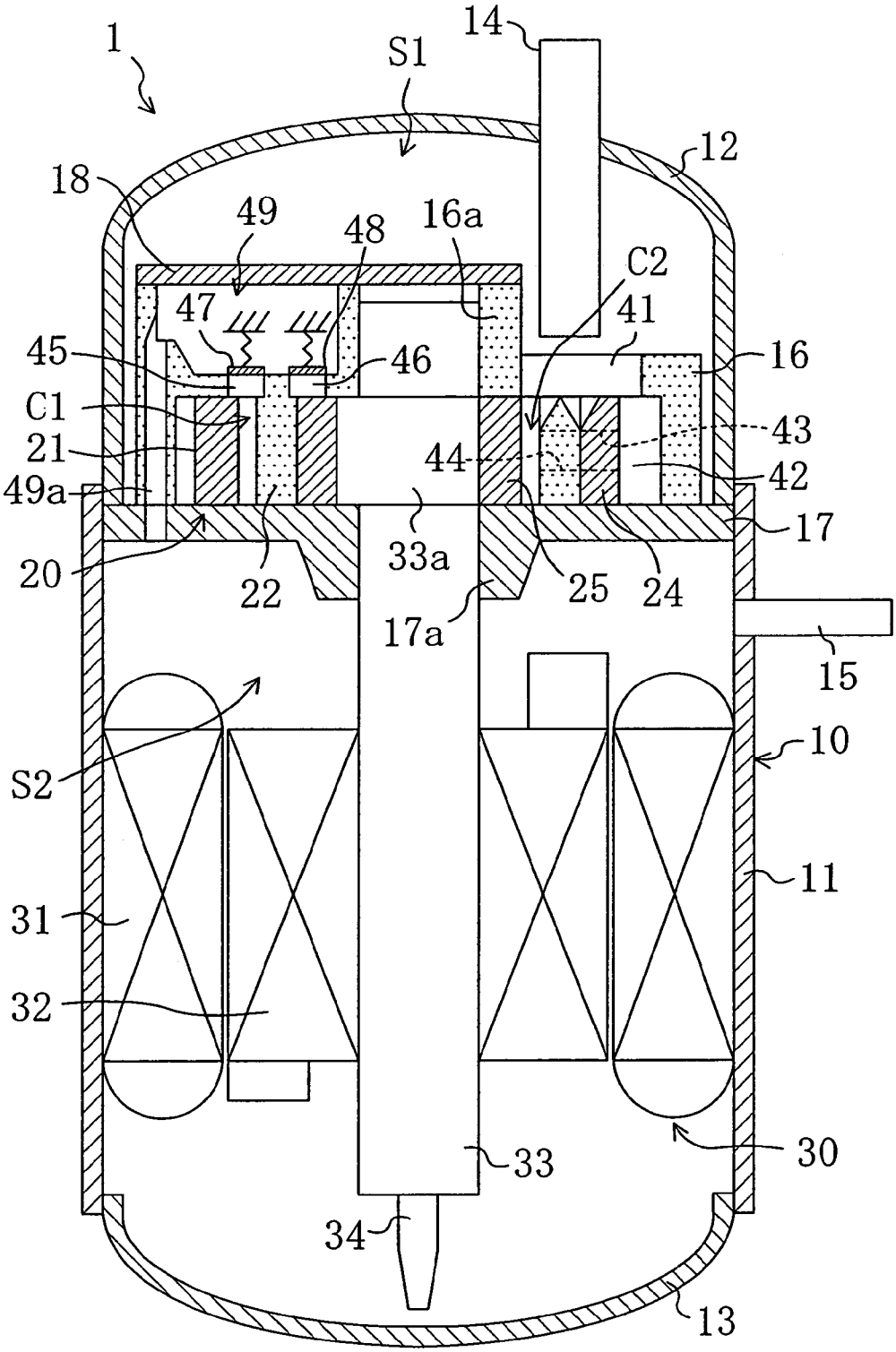
FIG. 5 is a longitudinal cross-sectional view illustrating a rotary compressor according to a third modified example of the first embodiment.

A third modified example of the first embodiment is illustrated in FIG. 5.

In the third modified example, the structure of the inside of the casing (10) in which a body portion (11) and an upper end plate (12) are joined together in the example illustrated in FIG. 3 is changed. In this modified example, like the second modified example, the body portion (11) has a length that allows its upper end to project slightly above a lower housing (17), and the lower housing (17) is welded to the body portion (11). Furthermore, an upper housing (16) is formed to have a smaller diameter than the internal diameter of the upper end plate (12) and fixed on the lower housing (17). The upper end plate (12) is welded to an upper end part of the body portion (11).

On the other hand, in this modified example, the high pressure space (S2) is sealed at the location at which the body portion (11) and the lower housing (17) are joined together. Therefore, the low pressure space (S1) above the lower housing (17) is completely isolated from the high pressure space (S2). On the other hand, since in the structure illustrated in FIG. 3 the lower housing (17) and the upper housing (16) are fitted into the body portion (11), a high-pressure gas may leak through a minute gap between the body portion (11) and the lower housing (17) around the upper housing (16).

On the other hand, in this modified example, the high pressure space (S2) is sealed at the location at which the body portion (11) and the lower housing (17) are joined together, and a space is produced between the upper end plate (12) and the upper housing (16) so that the outer peripheral face of the compression mechanism (20) is surrounded by the low pressure space (S1). In view of the above, a high-temperature discharge gas inside the high pressure space (S2) does not leak around the upper housing (16). This can certainly prevent a suction gas from being superheated by the discharge gas.

Embodiment 2 of Invention

In a second embodiment of the present invention, the structure of a compression mechanism (20) of the first embodiment is partly changed.

In the second embodiment, as illustrated in FIG. 6, the compression mechanism (20) of the first embodiment is turned upside down, and the suction structure thereof is changed. To be specific, a cylinder (21) is formed integrally by coupling the respective upper ends of the outer cylinder (24) and the inner cylinder (25) with an end plate (26). An annular piston (22) is formed continuously with a lower housing (17). A sealing ring (29) is inserted into an annular groove (16*b*) of an upper housing (16) and pressed against the top face of the end plate (26) of the cylinder (21).

A suction pipe (14) is horizontally oriented in a body portion (11) of a casing (10). A suction port (41) is formed in the lower housing (17) to communicate with the suction pipe (14). The lower housing (17) is formed with a suction space (42) communicating with the suction port (41) and a suction passage (42*a*) through which the suction space (42) is connected to a low pressure chamber (C1-Lp) of an outer cylinder chamber (C1) and a low pressure chamber (C2-Lp) of an inner cylinder chamber (C2). The suction space (42) is connected through a through hole (43) of the outer cylinder (24) to the low pressure chamber (C1-Lp) of the outer cylinder chamber (C1) and further connected through a through hole (44) of the annular piston (22) to the low pressure chamber (C2-Lp) of the inner cylinder chamber (C2). The suction space (42) is open to the low pressure space (S1) above the compression chamber (20).

The lower housing (17) is formed with discharge ports (45, 46). A discharge valve (47) is attached to the discharge port (45) of the outer cylinder chamber (C1), and a discharge valve (48) is attached to the discharge port (46) of the inner cylinder chamber (C2). A cover plate (18) is placed on the lower face of the lower housing (17). A discharge space (49) is formed between the lower housing (17) and the cover plate (18) and connected through an unshown discharge passage to the high pressure space (S2) below the compression mechanism (20).

In the second embodiment, an O ring (29*a*) is placed in part of the face of the lower housing (17) fitted into the body portion (11) and located below the cylinder chambers (C1, C2). In this embodiment, a high pressure space (S2) is sealed by the O ring (29*a*), and a high pressure gas does not leak above the location at which the high pressure space (S2) is sealed. In view of the above, the compression mechanism (20) is located completely at the low pressure space (S1) side like the second and third modified examples of the first embodiment and configured to prevent a suction gas from being superheated by a high-temperature discharge gas in the high pressure space (S2).

The structures of the other components are identical with those of the first embodiment.

In the second embodiment, like the first embodiment, a low pressure space (S1) can form a buffer space in the suction of a suction gas into a compression mechanism (20) without direct-coupling a suction pipe (14) to low pressure chambers (suction chambers) (C1-Lp, C2-Lp) of the compression mechanism (20). Therefore, pressure pulsation caused in the suction process in each cylinder chamber (C1, C2) does not propagate through the suction pipe (14) into the system of a refrigerant circuit. This can prevent vibration of apparatuses or pipes for the refrigerant circuit and production of noises. Likewise, pressure pulsation at the discharge side can be prevented, and deterioration in the performance of the compressor due to loss caused by superheat of suction gas can also be prevented.

Like the first embodiment, the swing bush (27) is provided as a coupling member through which the annular piston (22) and the blade (23) are coupled to each other and configured to be substantially in surface contact at their sliding faces (P1, P2) with the annular piston (22) and the blade (23). This can prevent the wearing-away of the annular piston (22) and the blade (23) during operation and the burning of the contact portions thereof.

Like the first embodiment, since the swing bush (27) is provided in surface contact with the annular piston (22) and the blade (23), this allows portions of the swing bush (27) being in contact with the annular piston (22) and the blade (23) to have an excellent sealing function. This can certainly prevent a leak of refrigerant from the high pressure chamber (C1-Hp, C2-Hp) to the low pressure chamber (C1-Lp, C2-Lp) of each of the outer cylinder chamber (C1) and the inner cylinder chamber (C2), leading to the prevented reduction in compression efficiency.

The same effects as in the first embodiment, i.e., not only vibration reduction and noise reduction both resulting from the reduced amplitude of the entire torque curve and cost reduction but also simplification of the compressor structure as compared with the conventional two-cylinder type compressor and prevention of liquid compression, can be achieved.

Embodiment 3 of Invention

In the first and second embodiments, the annular piston (22) is fixed and the cylinder (21) is movable. However, in the third embodiment, a cylinder (21) is fixed and an annular piston (22) is movable.

In the third embodiment, as illustrated in FIG. 7, a compression mechanism (20) is formed in the upper part of a casing (10) between an upper housing (16) and a lower housing (17) like the previously-described embodiments.

On the other hand, unlike the previously-described embodiments, the upper housing (16) is formed with an outer cylinder (24) and an inner cylinder (25). The outer cylinder (24) and the inner cylinder (25) are formed continuously with the upper housing (16), thereby forming a cylinder (21).

The annular piston (22) is supported between the upper housing (16) and the lower housing (17). The annular piston (22) is formed continuously with an end plate (26). The end plate (26) is formed with a hub (26*a*) slidably fitted onto an eccentric portion (33*a*) of a drive shaft (33). With this structure, rotation of the drive shaft (33) allows the annular piston (22) to eccentrically rotate in cylinder chambers (C1, C2). A blade (23) is formed continuously with the cylinder (21) like the previously-described embodiments.

The upper housing (16) is formed with the following ports: a suction port (41) through which a low pressure space (S1) located in the casing (10) and above the compression mechanism (20) communicates with the outer cylinder chamber (C1) and the inner cylinder chamber (C2); a discharge port (45) of the outer cylinder chamber (C1); and a discharge port (46) of the inner cylinder chamber (C2). A suction space (42) is formed between the hub (26*a*) and the inner cylinder (25) to communicate with the suction port (41). A through hole (44) and a through hole (43) are formed in the inner cylinder (25) and the annular piston (22), respectively. Chamfered are parts of the respective upper ends of the annular piston (22) and the inner cylinder (25) corresponding to the suction port (41).

A cover plate (18) is placed above the compression mechanism (20), and a discharge space (49) is formed between the upper housing (16) and the cover plate (18). The discharge space (49) is connected through a discharge passage (49*a*) formed in the upper housing (16) and the lower housing (17) to a high pressure space (S2) below the compression mechanism (20).

In the third embodiment, like examples illustrated in FIGS. 4 and 5, the body portion (11) has a length that allows its upper end to project slightly above a lower housing (17), and the lower housing (17) is welded to the body portion (11). Furthermore, an upper housing (16) is formed to have a smaller diameter than the internal diameter of the upper end plate (12) and fixed on the lower housing (17). The upper end plate (12) is welded to an upper end part of the body portion (11).

Also with this structure, a high pressure space (S2) is sealed at the locations at which the body portion (11) and the lower housing (17) are joined together. Therefore, a low pressure space (S1) above the lower housing (17) is completely isolated from the high pressure space (S2). The outer peripheral face of the compression mechanism (20) is surrounded by the low pressure space (S1). This prevents a suction gas from being superheated by a high-temperature discharge gas inside the high pressure space (S2).

In the third embodiment, like the first and second embodiments, a low pressure space (S1) can form a buffer space in the suction of a suction gas into a compression mechanism (20) without direct-coupling a suction pipe (14) to low pressure chambers (suction chambers) (C1-Lp, C2-Lp) of the compression mechanism (20). Therefore, pressure pulsation caused in the suction process in each cylinder chamber (C1, C2) does not propagate through the suction pipe (14) into the system of a refrigerant circuit. This can prevent vibration of apparatuses or pipes for the refrigerant circuit and production of noises. Likewise, pressure pulsation at the discharge side can be prevented, and deterioration in the performance of the compressor due to loss caused by superheat of suction gas can also be prevented.

Like the previously-described embodiments, the swing bush (27) is provided as a coupling member through which the annular piston (22) and the blade (23) are coupled to each other and is configured to be substantially in surface contact at their sliding faces (P1, P2) with the annular piston (22) and the blade (23). This can prevent the wearing-away of the annular piston (22) and the blade (23) during operation and the burning of the contact portions thereof.

Like the previously-described embodiments, since the swing bush (27) is provided in surface contact with the annular piston (22) and the blade (23), this allows portions of the swing bush (27) being in contact with the annular piston (22) and the blade (23) to have an excellent sealing function. This can certainly prevent a leak of refrigerant from the high pressure chamber (C1-Hp, C2-Hp) to the low pressure chamber (C1-Lp, C2-Lp) of each of the outer cylinder chamber (C1) and the inner cylinder chamber (C2), leading to the prevented reduction in compression efficiency.

The same effects as in the first embodiment, i.e., not only vibration reduction and noise reduction both resulting from the reduced amplitude of the entire torque curve and cost reduction but also simplification of the compressor structure as compared with the conventional two-cylinder type compressor and prevention of liquid compression, can be achieved.

Embodiment 4 of Invention

In a fourth embodiment of the present invention, as illustrated in FIG. 8, the compression mechanism (20) of each of the second and third modified examples of the first embodiment (FIGS. 4 and 5) and the third embodiment (FIG. 7) is changed.

The fourth embodiment of the present invention will be more specifically described as follows. In the examples illustrated in FIGS. 4, 5 and 7, the annular piston (22) is eccentrically accommodated in an annular cylinder chamber (C1, C2), thereby sectioning the cylinder chamber (C1, C2) into the outer cylinder chamber (C1) and the inner cylinder chamber (C2). On the other hand, in the fourth embodiment of the present invention, a cylinder chamber (C) is formed to have a circular shape in section at a right angle in the axial direction, and a circular piston (22) eccentrically accommodated in the cylinder chamber (C) is used as a piston (22). In this manner, the cylinder chamber (C) is not sectioned into two chambers, i.e., inner and outer chambers.

The compression mechanism (20) is formed between a lower housing (17) fixed to a casing (10) and an upper housing (16) fixed on the lower housing (17). The compression mechanism (20) includes a cylinder (21) having a cylinder chamber (C) in a circular shape in section at a right angle in the axial direction, a circular piston (22) arranged in the cylinder chamber (C), and a blade (23) for sectioning the cylinder chamber (C) into a high pressure chamber (compression chamber) (C-Hp) and a low pressure chamber (suction chamber) (C-Lp). In the fourth embodiment, the cylinder (21) having the cylinder chamber (C) is fixed, and the piston (22) arranged in the cylinder chamber (C) is movable. The piston (22) eccentrically rotates relative to the cylinder (21).

An eccentric portion (33*a*) is formed at a part of the drive shaft (33) of a motor (30) located inside the cylinder chamber (C). The eccentric portion (33*a*) has a diameter larger than parts of the drive shaft (33) located above and below the eccentric portion (33*a*) and is eccentric from the axial center of the drive shaft (33) by a predetermined distance. The piston (22) is fitted onto the eccentric portion (33*a*).

The upper housing (16) is formed with the cylinder (21) having the cylinder chamber (C). The upper housing (16) and the lower housing (17) are formed with bearing portions (16*a*, 17*a*) for supporting the drive shaft (33), respectively. In view of the above, the compressor (1) of this embodiment takes on a through-axis structure in which the drive shaft (33) vertically passes through the cylinder chamber (C) and parts of the drive shaft (33) located to both longitudinal sides of the eccentric portion (33*a*) are supported through the bearing portions (16*a*, 17*a*) in the casing (10).

Figure 9:
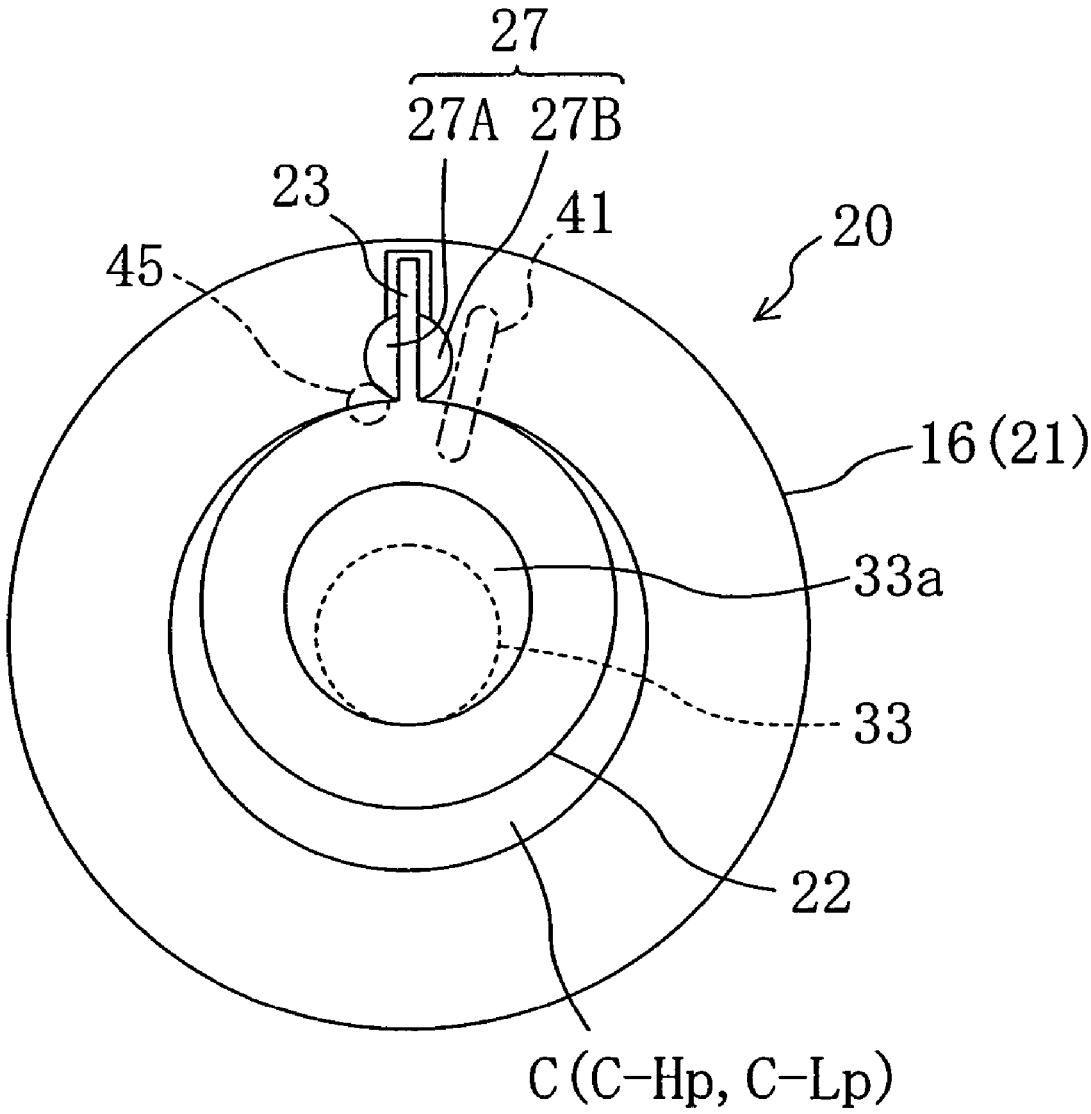
FIG. 9 is a transverse cross-sectional view illustrating a compression mechanism of the rotary compressor illustrated in FIG. 8.

As illustrated in FIG. 9, in the compression mechanism (20) of this embodiment, the blade (23) is formed continuously with the piston (22). The compression mechanism (20) of this embodiment represents a so-called swing type compression mechanism in which the blade (23) is supported through a swing bush (27) by the cylinder (21).

A suction port (41) is formed in a part of the upper housing (16) under the suction pipe (14). The suction port (41) passes axially through the upper housing (16) to allow the low pressure chamber (C-Lp) of the cylinder chamber (C) to communicate with a space (a low pressure space (S1)) above the upper housing (16).

A discharge port (45) is formed in the upper housing (16) and passes axially through the upper housing (16). The lower end of the discharge port (45) is open to the high pressure chamber (C-Hp) of the cylinder chamber (C). On the other hand, the upper end of the discharge port (45) communicates with a discharge space (49) through a discharge valve (reed valve) (47) for opening/closing the discharge port (45).

The discharge space (49) is formed between the upper housing (16) and a cover plate (18). A discharge passage (49*a*) for allowing the discharge space (49) and the space (a high pressure space (S2)) below the lower housing (17) to communicate with each other is formed in the upper housing (16) and the lower hosing (17).

In the fourth embodiment, like the examples illustrated in FIGS. 4, 5 and 7, the body portion (11) has a length that allows its upper end to project slightly above the lower housing (17), and the lower housing (17) is welded to the body portion (11). Furthermore, an upper housing (16) is formed to have a smaller diameter than the internal diameter of the upper end plate (12) and fixed on the lower housing (17). The upper end plate (12) is welded to an upper end part of the body portion (11).

Also with this structure, a high pressure space (S2) is sealed at the locations at which the body portion (11) and the lower housing (17) are joined together. Therefore, a low pressure space (S1) above the lower housing (17) is completely isolated from the high pressure space (S2). The outer peripheral face of the compression mechanism (20) is surrounded by the low pressure space (S1). This prevents a suction gas from being superheated by a high-temperature discharge gas inside the high pressure space (S2).

Also in the fourth embodiment, like the first through third embodiments, the inner end of the suction pipe (14) is exposed inside the low pressure space (S1) without direct-coupling the suction pipe (14) to the low pressure chamber (suction chamber) (C-Lp) of the compression mechanism (20). This allows the low pressure space (S1) to form a buffer space in the suction of a suction gas into the compression mechanism (20). Therefore, pressure pulsation caused in the suction process in the cylinder chamber (C) does not propagate through the suction pipe (14) into the system of a refrigerant circuit. This can prevent vibration of apparatuses or pipes for the refrigerant circuit and production of noises. Likewise, pressure pulsation at the discharge side can be prevented, and deterioration in the performance of the compressor due to loss caused by superheat of suction gas can also be prevented.

Embodiment 5 of Invention

Figure 10:
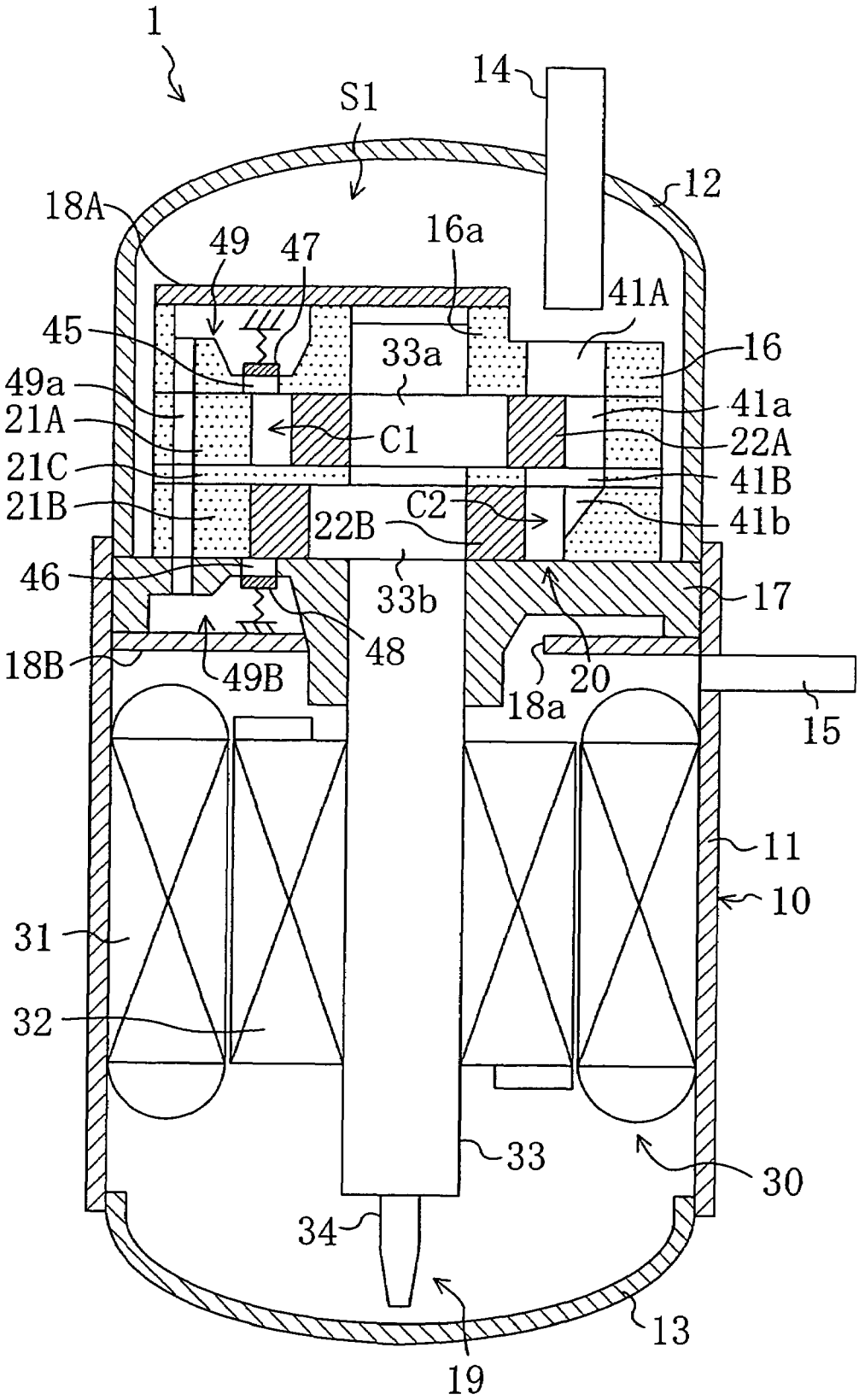
FIG. 10 is a longitudinal cross-sectional view illustrating a rotary compressor according to a fifth embodiment.
Figure 11:
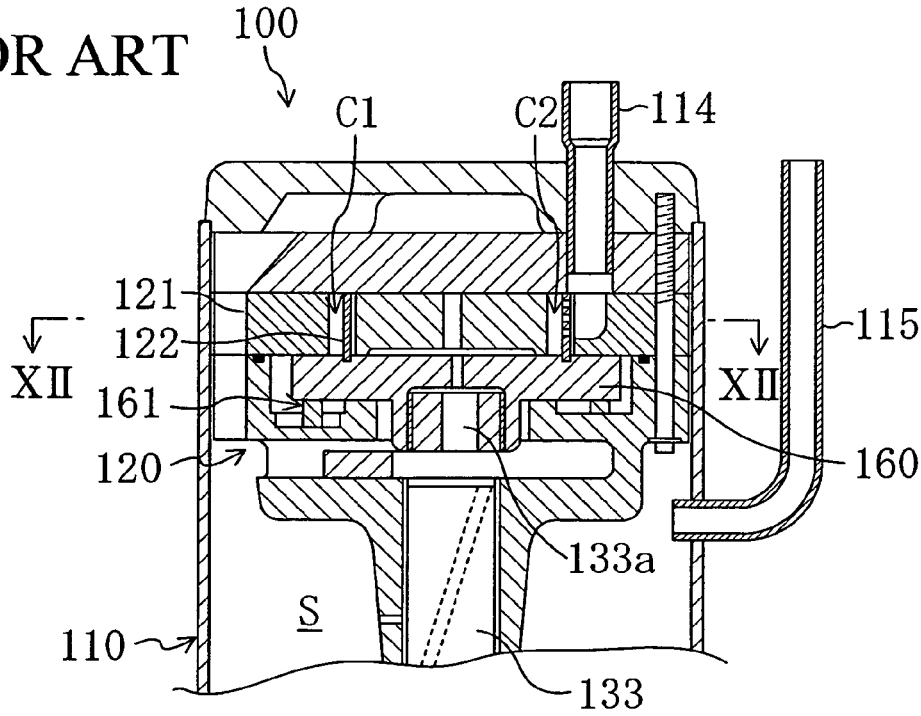
FIG. 11 PRIOR ART
FIG. 11 is a longitudinal cross-sectional view partly illustrating a rotary compressor according to a known art.
Figure 12:
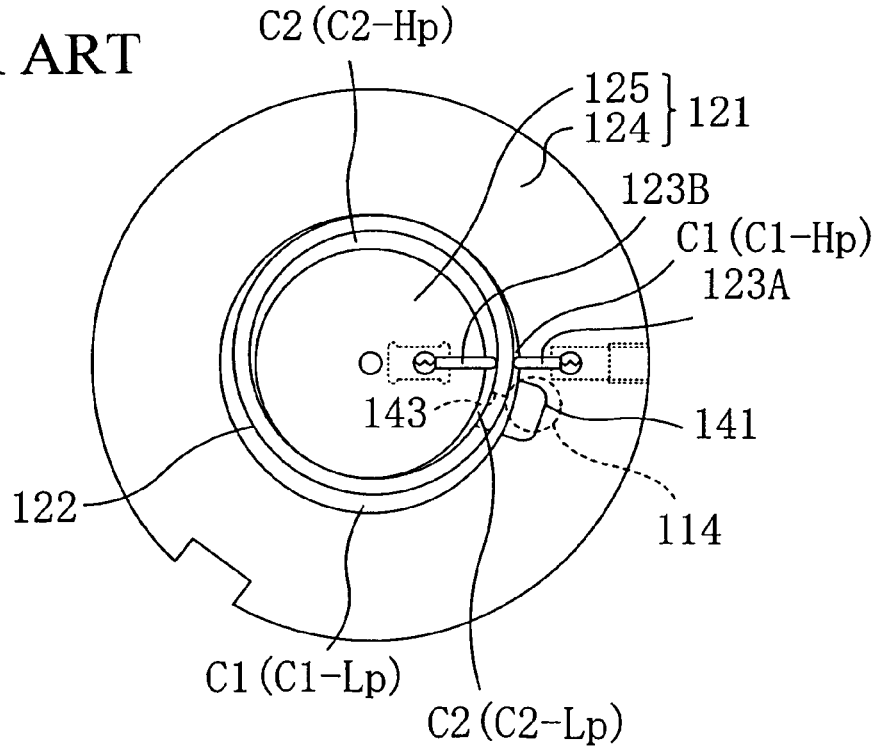
FIG. 12 PRIOR ART
FIG. 12 is a cross-sectional view taken along the line XII-XII in FIG. 11.
Figure 13:
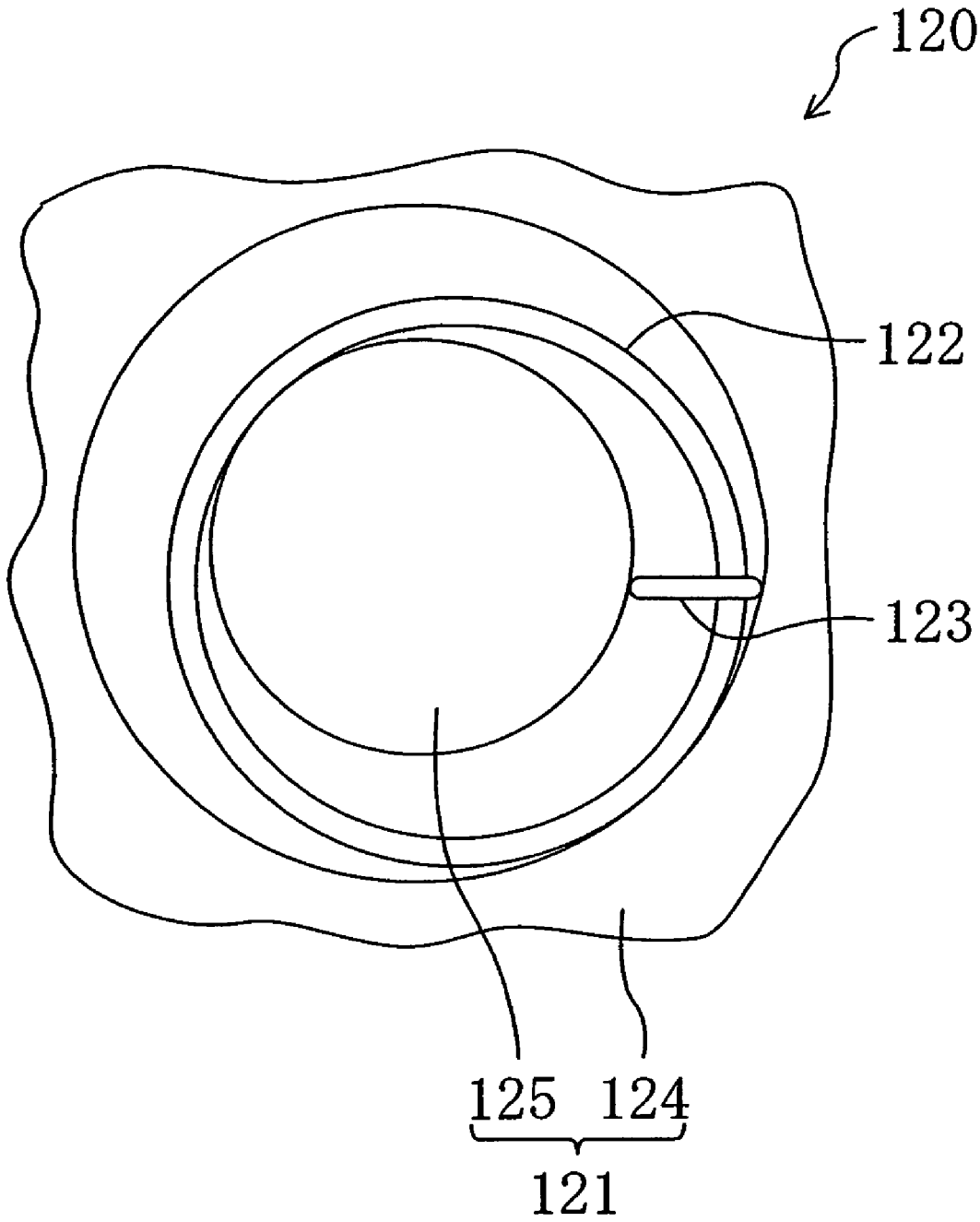
FIG. 13 PRIOR ART
FIG. 13 is a cross-sectional view illustrating a modified example of the rotary compressor illustrated in FIG. 12

In a fifth embodiment of the present invention, as illustrated in FIG. 10, one compression mechanism of the fourth embodiment is placed on another.

In FIG. 10, a lower housing (17) is welded to a body portion (11) of a casing (10). A second cylinder (21B), a middle plate (21C), a first cylinder (21A), and an upper housing (16) are placed on the lower housing (17) in bottom-to-top order and formed integrally by fastening members (not shown), such as bolts.

The first cylinder (21A) and the second cylinder (21B) have a circular first cylinder chamber (C1) and a circular second cylinder chamber (C2), respectively. A part of a drive shaft (33) located in the first cylinder chamber (C1) is formed with a first eccentric portion (33*a*), and a part thereof located in the second cylinder chamber (C2) is formed with a second eccentric portion (33*b*). The second eccentric portion (33*b*) becomes eccentric toward the direction 180 degrees away from the direction toward which the first eccentric portion (33*a*) becomes eccentric.

A first piston (22A) is fitted onto the first eccentric portion (33*a*), and a second piston (22B) is fitted onto the second eccentric portion (33*b*). The first piston (22A) is eccentrically accommodated in the first cylinder chamber (C1), and the second piston (22B) is eccentrically accommodated in the second cylinder chamber (C2). The first cylinder chamber (C1) is sectioned into a high pressure chamber and a low pressure chamber by a first blade (not shown), and the second cylinder (21B) is sectioned into a high pressure chamber and a low pressure chamber by a second blade (not shown). The rotation of the drive shaft (33) allows the first piston (22A) to eccentrically rotate while being substantially in contact at one point with the inner peripheral face of the first cylinder chamber (C1) and allows the second piston (22B) to eccentrically rotate while being substantially in contact at one point with the inner peripheral face of the second cylinder chamber (C2).

A first suction port (41A) is formed in the upper housing (16) to communicate with the low pressure chamber of the first cylinder chamber (C1), and a second suction port (41B) is formed in the middle plate (21C) to communicate with the low pressure chamber of the second cylinder chamber (C2). The first suction port (41A) and the second suction port (41B) are connected through a first suction passage (41*a*) formed in the second cylinder (21B) to each other. The first suction passage (41*a*) communicates at its side with the low pressure chamber of the first cylinder chamber (C1). A second suction passage (41*b*) is formed in the second cylinder (21B) to communicate at its side with the low pressure chamber of the second cylinder chamber (C2).

A first discharge port (45) is formed in the upper housing (16). The first discharge port (45) passes axially through the upper housing (16). The lower end of the first discharge port (45) opens to the high pressure chamber of the first cylinder chamber (C1). On the other hand, the upper end of the first discharge port (45) communicates with a first discharge space (49A) through a first discharge valve (reed valve) (47) for opening/closing the first discharge port (45). The first discharge space (49A) is formed between the upper housing (16) and a first cover plate (18A).

A second discharge port (46) is formed in the lower housing (17). The second discharge port (46) passes axially through the lower housing (17). The upper end of the second discharge port (46) opens to the high pressure chamber of the second cylinder chamber (C2). On the other hand, the lower end of the second discharge port (46) communicates with a second discharge space (49B) through a second discharge valve (reed valve) (48) for opening/closing the second discharge port (46). The second discharge space (49B) is formed between the lower housing (17) and a second cover plate (18B).

A discharge passage (49*a*) through which the first discharge space (49A) is connected to the second discharge space (49B) is formed in the upper housing (16), the first cylinder (21A), the middle plate (21C), the second cylinder (21B), and the lower housing (17). The second discharge space (49B) is continuously formed between the lower housing (17) and the second cover plate (18B) to extend circumferentially and connected through an opening (18*a*) of the second cover plate (18B) to a high pressure space below the second cover plate (18B).

In the fifth embodiment, like the examples illustrated in FIGS. 4, 5, 7, and 8, the body portion (11) has a length that allows its upper end to project slightly above the lower housing (17), and the lower housing (17) is welded to the body portion (11). Furthermore, the upper housing (16), the first cylinder (21A), the middle plate (21C), and the second cylinder (21B) are formed to each have a smaller diameter than the internal diameter of an upper end plate (12). Also with this structure, a high pressure space (S2) is sealed at the locations at which the body portion (11) and the lower housing (17) are joined together. Therefore, the low pressure space (S1) above the lower housing (17) is completely isolated from the high pressure space (S2). The outer peripheral face of the compression mechanism (20) is surrounded by the low pressure space (S1). This prevents a suction gas from being superheated by a high-temperature discharge gas inside the high pressure space (S2).

Also in the fifth embodiment, like the first through fourth embodiments, the inner end of the suction pipe (14) is exposed inside the low pressure space (S1) without direct-coupling the suction pipe (14) to the low pressure chamber (suction chamber) (C-Lp) of the compression mechanism (20). This allows the low pressure space (S1) to form a buffer space in the suction of a suction gas into the compression mechanism (20). Therefore, pressure pulsation caused in the suction process in the cylinder chamber (C) does not propagate through the suction pipe (14) into the system of a refrigerant circuit. This can prevent vibration of apparatuses or pipes for the refrigerant circuit and production of noises. Likewise, pressure pulsation at the discharge side can be prevented, and deterioration in the performance of the compressor due to loss caused by superheat of suction gas can also be prevented.

Other Embodiments

The present invention may have the following variations on the above embodiments.

In the first through third embodiments, an annular piston (22) has a shape of C obtained by cutting an annular ring. While a blade (23) is inserted through the cut part of the annular ring, it is coupled through a swing bush (27) to the annular piston (22). However, a swing bush (27) does not necessarily have to be provided.

More particularly, according to the present invention, in a rotary compressor comprising a compression mechanism (20) which includes a cylinder (21), a piston (22) eccentrically disposed in a cylinder chamber (C1, C2) of the cylinder (21), and a blade (23) sectioning the cylinder chamber (C1, C2) into a high pressure chamber (C1-Hp, C2-Hp) and a low pressure chamber (C1-Lp, C2-Lp) and in which the cylinder (21) and the piston (22) eccentrically rotate relative to each other, a low pressure space (S1) formed in a casing (10) is used as a buffer space for air suction into the compression mechanism (20). Under these conditions, the other specific structures may be appropriately changed.

Although, for example, in the previously-described embodiments, a blade (23) is disposed on a line extending along the radial direction, the blade (23) may be inclined to some extent from the line extending along the radial direction.

It is noted that the above embodiments are substantially preferred examples and are not intended to limit the scope of the present invention, applicable objects thereof, and applicable range thereof.

INDUSTRIAL APPLICABILITY

As described above, the present invention is useful for rotary compressors including a compression mechanism in which an annular piston (22) is disposed inside an annular cylinder chamber (C1, C2) of a cylinder (21), the cylinder (21) and the annular piston (22) eccentrically rotate relative to each other, and furthermore the cylinder chamber (C1, C2) is sectioned into a high pressure chamber (C1-Hp, C2-Hp) and a low pressure chamber (C1-Lp, C2-Lp) by a blade (23).

What is claimed is:

1. A rotary compressor comprising:

a compression mechanism including a cylinder having a cylinder chamber, a piston disposed in the cylinder chamber to be eccentric with respect to the cylinder, and a blade arranged in the cylinder chamber and dividing the cylinder chamber into a high pressure chamber and a low pressure chamber, the cylinder and the piston eccentrically moving relative to each other;

a motor configured to drive the compression mechanism; and a casing configured to house the compression mechanism and the motor, the casing forming a low pressure space communicating with a suction port of the compression mechanism and a high pressure space communicating with a discharge side of the compression mechanism, an outer peripheral face of the compression mechanism being surrounded by the low pressure space, the suction port having an inner end open to the cylinder chamber and an outer end open to the low pressure space, the casing having a suction pipe fluidly connected to the low pressure space of the casing and a discharge pipe connected to a high pressure space side thereof, the suction pipe having an open end spaced from the outer end of the suction port and disposed in the low pressure space such that the open free end of the suction pipe opens into the low pressure space to directly supply fluid into the low pressure space and indirectly supply fluid to the outer end of the suction port via the low pressure space, and the compression mechanism being provided with a discharge space formed between a housing of the compression mechanism and a cover plate, a discharge port passing through the housing to communicate the high pressure chamber with the discharge space, and a discharge passage configured to allow the discharge space to communicate with the high pressure space, the entire discharge passage passing through the housing.

2. The rotary compressor of claim 1, wherein the casing forms two spaces and the compression mechanism is interposed therebetween, one of the two spaces is the high pressure space, and the other thereof is the low pressure space.

3. The rotary compressor of claim 1, wherein the motor is disposed in the high pressure space.

4. The rotary compressor of claim 1, wherein the high pressure space is formed below the compression mechanism, and an oil sump for accumulating lubrication oil is formed in the high pressure space.

5. The rotary compressor of claim 1, wherein the cylinder chamber has an annular cross section when viewed at a right angle in an axial direction, and the piston is formed of an annular piston arranged in the cylinder chamber and sectioning the cylinder chamber into an outer cylinder chamber and an inner cylinder chamber.

6. The rotary compressor of claim 5, wherein the blade is formed continuously with the cylinder, the rotary compressor further includes a coupling member through which the annular piston and the blade are movably coupled to each other, and the coupling member includes a first sliding face corresponding to the annular piston and a second sliding face corresponding to the blade.

7. The rotary compressor of claim 6, wherein the annular piston is C-shaped to form a gap, the blade is formed to extend from an inner peripheral wall surface of the annular cylinder chamber to an outer peripheral wall surface thereof while being inserted through the gap of the annular piston, and the coupling member is a swing bushing having an arc-shaped outer peripheral face slidably supported in the gap of the annular piston, a blade groove being formed therein for supporting the blade to allow the blade to move back and forth.

8. The rotary compressor of claim 5 further comprising a drive shaft configured to drive the compression mechanism, the drive shaft including an eccentric portion that is eccentric from a rotation center, the eccentric portion being coupled to the cylinder or the annular piston, and parts of the drive shaft located at both longitudinal sides of the eccentric portion are supported through a plurality of bearing portions in the casing.

9. The rotary compressor of claim 1, wherein the cylinder chamber has a circular cross section when viewed at a right angle in an axial direction, and the piston is formed of a circular piston arranged in the cylinder chamber.

* * * * *